United States Patent [19]

Chujo et al.

[11] Patent Number: 4,693,076

[45] Date of Patent: Sep. 15, 1987

[54] DOUBLE AIR-FUEL RATIO SENSOR SYSTEM HAVING IMPROVED RESPONSE CHARACTERISTICS

[75] Inventors: Yoshiki Chujo, Mishima; Nobuaki Kayanuma, Gotenba; Hironori Bessho, Susono; Takatoshi Masui, Mishima; Toshinari Nagai, Susono; Toshiyasu Katsuno, Susono; Toshio Tanahashi, Susono, all of Japan

[73] Assignee: Toyota Jidosha Kabushiki Kaisha, Aichi, Japan

[21] Appl. No.: 848,580

[22] Filed: Apr. 7, 1986

[30] Foreign Application Priority Data

| | | | |
|---|---|---|---|
| Apr. 9, 1985 | [JP] | Japan | 60-73555 |
| Apr. 10, 1985 | [JP] | Japan | 60-74439 |
| Sep. 11, 1985 | [JP] | Japan | 60-199337 |

[51] Int. Cl.[4] ..... F02D 41/14

[52] U.S. Cl. ..... 60/274; 60/276; 60/285; 123/489

[58] Field of Search ..... 123/440, 489, 589; 60/276, 285, 274; 364/431.05

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,130,095 | 12/1978 | Bowler et al. | 123/440 |
| 4,235,204 | 11/1980 | Rice | 123/440 |
| 4,475,517 | 10/1984 | Kobayashi et al. | 123/489 |
| 4,539,958 | 9/1985 | Ito et al. | 123/440 |
| 4,561,400 | 12/1985 | Hattori | 123/478 |
| 4,571,683 | 2/1986 | Kobayashi et al. | 364/431.05 |

FOREIGN PATENT DOCUMENTS

| | | |
|---|---|---|
| 52-102934 | 8/1977 | Japan . |
| 53-103796 | 9/1978 | Japan . |
| 55-37562 | 3/1980 | Japan . |
| 57-32772 | 7/1982 | Japan . |
| 57-32773 | 7/1982 | Japan . |
| 57-32774 | 7/1982 | Japan . |
| 58-27848 | 2/1983 | Japan . |
| 58-48755 | 3/1983 | Japan . |
| 58-48756 | 3/1983 | Japan . |
| 58-53661 | 3/1983 | Japan . |
| 58-72647 | 4/1983 | Japan . |
| 58-72646 | 4/1983 | Japan . |
| 58-135343 | 8/1983 | Japan . |
| 58-150039 | 9/1983 | Japan . |
| 58-150038 | 9/1983 | Japan . |
| 58-152147 | 9/1983 | Japan . |
| 59-32644 | 2/1984 | Japan . |
| 59-206638 | 11/1984 | Japan . |
| 60-1340 | 1/1985 | Japan . |
| 60-26138 | 2/1985 | Japan . |
| 60-53635 | 3/1985 | Japan . |
| 61-34330 | 2/1986 | Japan . |
| 61-53436 | 3/1986 | Japan . |

*Primary Examiner*—Andrew M. Dolinar
*Attorney, Agent, or Firm*—Parkhurst & Oliff

[57] ABSTRACT

In a double air-fuel sensor system including two air-fuel ratio sensors upstream and downstream of a catalyst converter provided in an exhaust gas passage, an air-fuel ratio correction amount is remarkably changed when the output of the upstream-side air-fuel ratio sensor is switched from the lean side to the rich side or vice versa, and the actual air-fuel ratio is adjusted in accordance with the air-fuel ratio correction amount. The remarkable-change speed of the air-fuel ratio correction amount is changed in accordance with the output of the downstream-side air-fuel ratio sensor.

36 Claims, 54 Drawing Figures

| Fig.6A | Fig.6B |
|---|---|

| Fig.7A | Fig.7B |
|---|---|

A/F1
LEAN
RICH
TDL1
CDLY1
0
t1 t2 t3 t4 t5 t6 t7 t8
TDR1
F1
(-TDR1)
TDL1
(-TDR1)
LEAN
RICH
KIR
FAF
KIL
RSL
RSR

DOUBLE AIR-FUEL RATIO SENSOR SYSTEM HAVING IMPROVED RESPONSE CHARACTERISTICS

BACKGROUND OF THE INVENTION

1. Field of the Invention

The present invention relates to a method and apparatus for feedback control of an air-fuel ratio in an internal combustion engine having two air-fuel ratio sensors upstream and downstream of a catalyst converter disposed within an exhaust gas passage.

2. Description of the Related Art

Generally, in a feedback control of the air-fuel ratio in a single air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output signal of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio. According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC, and $NO_x$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio correction amount FAF is also fluctuated, thereby causing fluctuations in the controlled air-fuel ratio.

To compensate for the fluctuation of the controlled air-fuel ratio, double $O_2$ sensor systems have been suggested (see: Japanese Unexamined Patent Publication (Kokai) Nos. 55-37562, 58-48755, and 58-72647). In such a double $O_2$ sensor system, another $O_2$ sensor is provided downstream of the catalyst converter, and thus another air-fuel ratio operation is carried out by correcting delay time parameters of an air-fuel ratio operation of the upstream-side $O_2$ sensor with the output of the downstream-side $O_2$ sensor. That is, in a single $O_2$ sensor system, the switching of the output of the upstream-side $O_2$ sensor from the rich side to the lean side or vice versa is delayed for a definite time period thereby stabilizing the feedback control, but such a definite time period is variable in the above-mentioned double $O_2$ sensor system. In this double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons:

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalyst converter, these pollutants have little affect on the downstream-side $O_2$ sensor.

(3) On the downstream side of the catalyst converter, the exhaust gas is mixed so that the concentration of oxygen in the exhaust gas is approximately in the equilibrium state.

Therefore, according to the double $O_2$ sensor system, the fluctuation of the output of the upstreamside $O_2$ sensor is compensated for by a feedback control using the output of the downstream-side $O_2$ sensor. That is, even when the upstream-side $O_2$ sensor is deteriorated, the emissions such as HC, CO, and $NO_x$ can be minimized by the correction of the delay time parameters by the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

In the above-mentioned double $O_2$ sensor system, however, when the upstream-side $O_2$ sensor is deteriorated so that the controlled center thereof is shifted, one of the delay time parameters corrected by the downstream-side $O_2$ sensor is too large, thereby reducing the response speed (i.e., the control frequency), thus reducing the accuracy of the feedback control. For example, as shown in FIG. 2A, when the upstream-side $O_2$ sensor, which generates an output voltage $V_1$, is only slightly deteriorated, a rich time parameter TDR, for which the switching of the output of the upstream-side $O_2$ sensor from the lean side to the rich side is delayed, is set at 32 ms, and a lean time parameter TDL, for which the switching of the output of the upstream-side $O_2$ sensor from the rich side to the lean side is delayed, is also set at 32 ms, so that the frequency of the feedback control is about 1.3 Hz. Contrary to this, when the upstream-side $O_2$ sensor is deteriorated, the rich time parameter TDR is set at 8 ms and the lean time parameter TDL is set at 256 ms, so that the frequency of the feedback control is about 0.93 Hz. This means that the response characteristics are reduced by about 30%, and surging may be generated. In FIGS. 2A and 2B, FAF designates an air-fuel ratio correction amount which will be explained later.

Note that, in order to avoid the reduction of the response speed, a maximum limit is imposed on the delay time parameters corrected by the output of the downstream-side $O_2$ sensor (see: FIG. 4 of Japanese Unexamined Patent Publication (Kokai) No. 58-72647). In this case, when one of the delay time parameters reaches such a maximum limit, the feedback control by the downstream-side $O_2$ sensor is substantially suspended, i.e., a double $O_2$ sensor system is suspended.

SUMMARY OF THE INVENTION

It is an object of the present invention to provide a double air-fuel ratio sensor ($O_2$ sensor) system in whch the response characteristics of the entire system are not deteriorated even when the response characteristics of the upstream-side air-fuel ratio are deteriorated.

According to the present invention, in a double air-fuel sensor system including two air-fuel ratio sensor upstream and downstream of a catalyst converter provided in an exhaust gas passage, an air-fuel ratio correction amount is remarkably changed when the output of the upstream-side air-fuel ratio sensor is switched from the lean side to the rich side, or vice versa, and the actual air-fuel ratio is adjusted in accordance with the air-fuel ratio correction amount. The remarkable change speed of the air-fuel ratio correction amount is changed in accordance with the output of the downstream-side air-fuel ratio sensor. That is, skip amounts of the feedback control by upstream-side air-fuel ratio sensor are variable in accordance with the output of the downstream-side air-fuel ratio sensor. As a result, when the upstream-side air-fuel ratio sensor is deteriorated so that the controlled center thereof is shifted, one of the skip amounts is too large; however, in this case, the response speed (i.e., the control frequency) is little reduced.

BRIEF DESCRIPTION OF THE DRAWINGS

The present invention will be more clearly understood from the description as set forth below with reference to the accompanying drawings, wherein:

FIGS. 4, 4A, 4B, 4C, 6, 6A, 6B, 7, 7A, 7B, 8, 11, 11A, 11B, 12, 12A, 12B, 15, 16, and 18 are flow charts showing the operation of the control circuit of FIG. 3;

DESCRIPTION OF THE PREFERRED EMBODIMENTS

Figure 3:
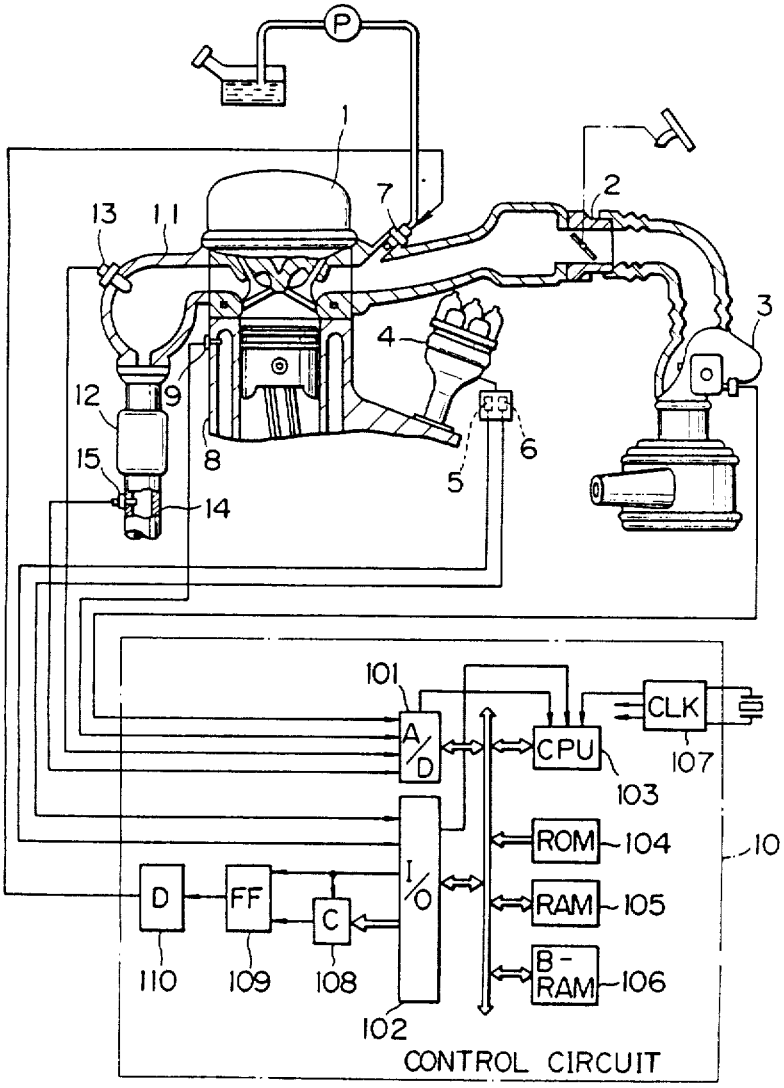
FIG. 3 is a schematic view of an internal combustion engine according to the present invention.

In FIG. 3, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air taken into the engine 1, to generate an analog voltage signal in proportion to the amount of air flowing therethrough. The signal from the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1. In this case, the crank-angle sensor 5 generates a pulse signal at every 720° crank angle (CA) while the crank-angle sensor 6 generates a pulse signal at every 30° CA. The pulse signals of the crank angle sensors 5 and 6 are supplied to an input/output (I/O) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, though not shown in FIG. 3.

Disposed in a cylinder block 8 of the engine 1 is a coolant temperature sensor 9 for detecting the temperature of the coolant. The coolant temperature sensor 9 generates an analog voltage signal in response to the temperature of the coolant and transmits it to the A/D converter 101 of the control circuit 10.

Provided in an exhaust system on the downstream-side of an exhaust manifold 11 is a three-way reducing an oxidizing catalyst converter 12 which removes three pollutants CO, HC, and $NO_x$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas. The $O_2$ sensor 13 and 15 generate output voltage signals and transmit them to the A/D converter 101 of the control circuit 10.

The control circuit 10, which may be constructed by a microcomputer, further comprises a central processing unit (CPU) 103, a ready-only memory (ROM) 104 for storing a main routine, interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is never erased even when the ignition switch (not shown) is turned off.

The down counter 108, the fip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107, and finally generates a logic "1" signal from the carry-out terminal thereof, to reset the flip-flop 109, so that the driver circuit 110 stops the activation of the fuel injection valve 14. Thus, the amount of fuel corresponding to the fuel injection amount TAU is injected into the fuel injection valve 7.

Interruptions occur at the CPU 103, when the A/D converter 101 completes an A/D conversion and generates an interrupt signal; when the crank angle sensor 6 generates a pulse signal; and when the clock generator 109 generates a special clock signal.

The intake air amount data Q of the airflow meter 3 and the coolant temperature data THW are fetched by an A/D conversion routine(s) executed at every predetermined time period and are then stored in the RAM 105. That is, the data Q and THW in the RAM 105 are renewed at every predetermined time period. The engine speed NE is calculated by an interrupt routine executed at 30° CA, i.e., at every pulse signal of the crank angle sensor 6, and is then stored in the RAM 105.

Figure 1:
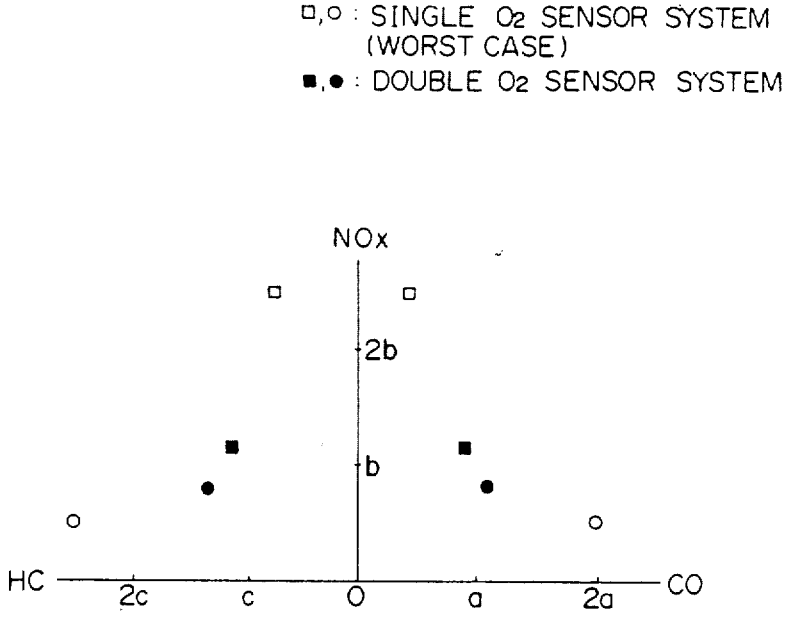
FIG. 1 is a graph showing the emission characteristics of a single $O_2$ sensor system and a double $O_2$ sensor system.
Figure 2A:
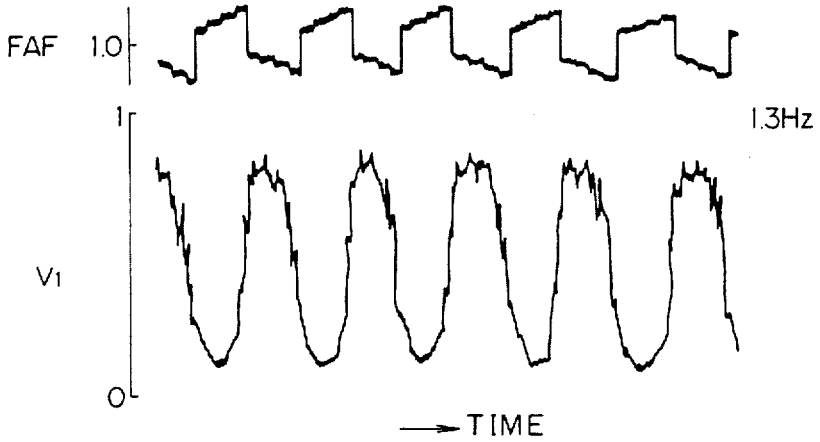
Fig.2A PRIOR ART
FIGS. 2A and 2B are timing diagrams showing the output characteristics of the upstream-side $O_2$ sensor.
Figure 2B:
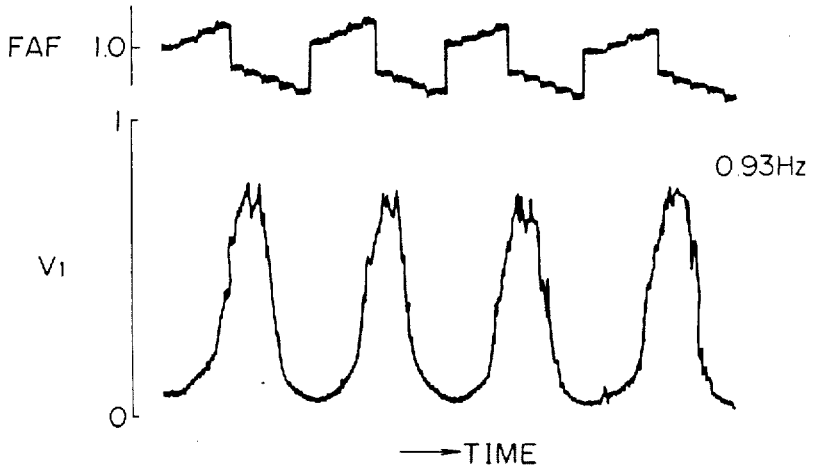
Fig.2B PRIOR ART

The operation of the control circuit 10 of FIG. 2 will be explained with reference to the flow charts of FIGS. 4, 6, 7, and 8.

Figure 4A:
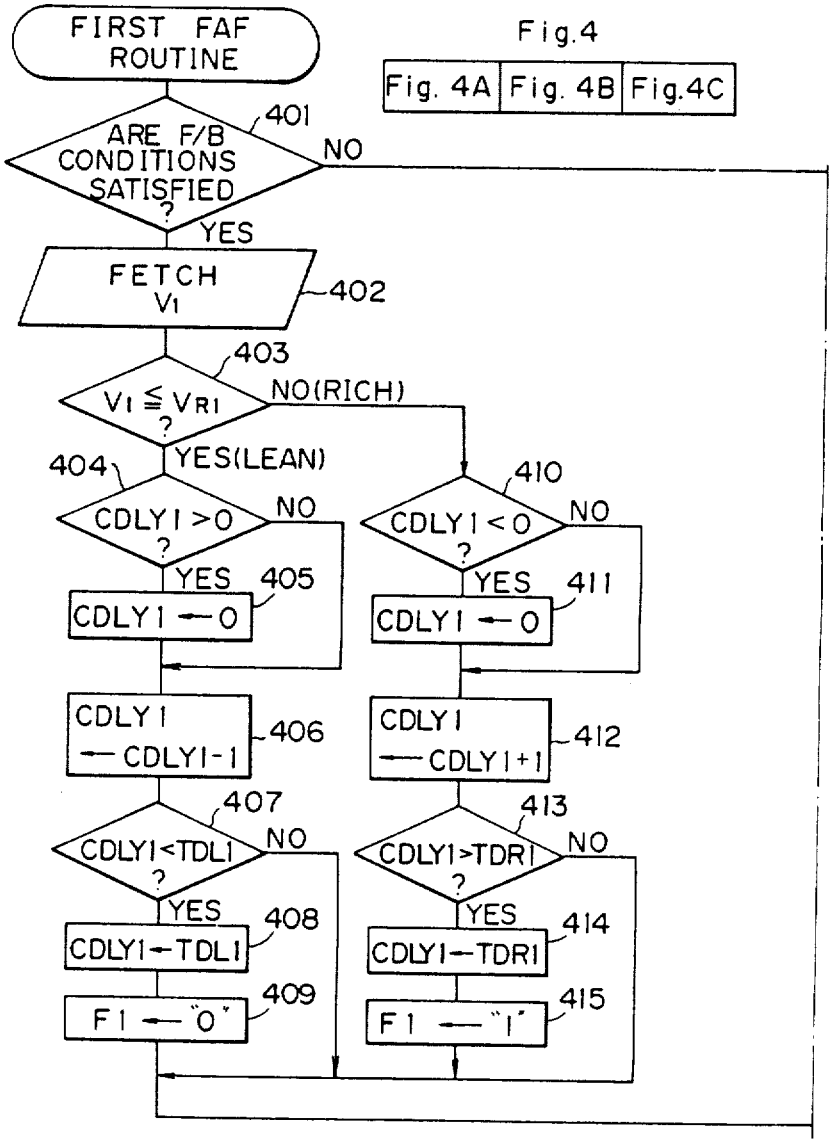
Figure 4B:
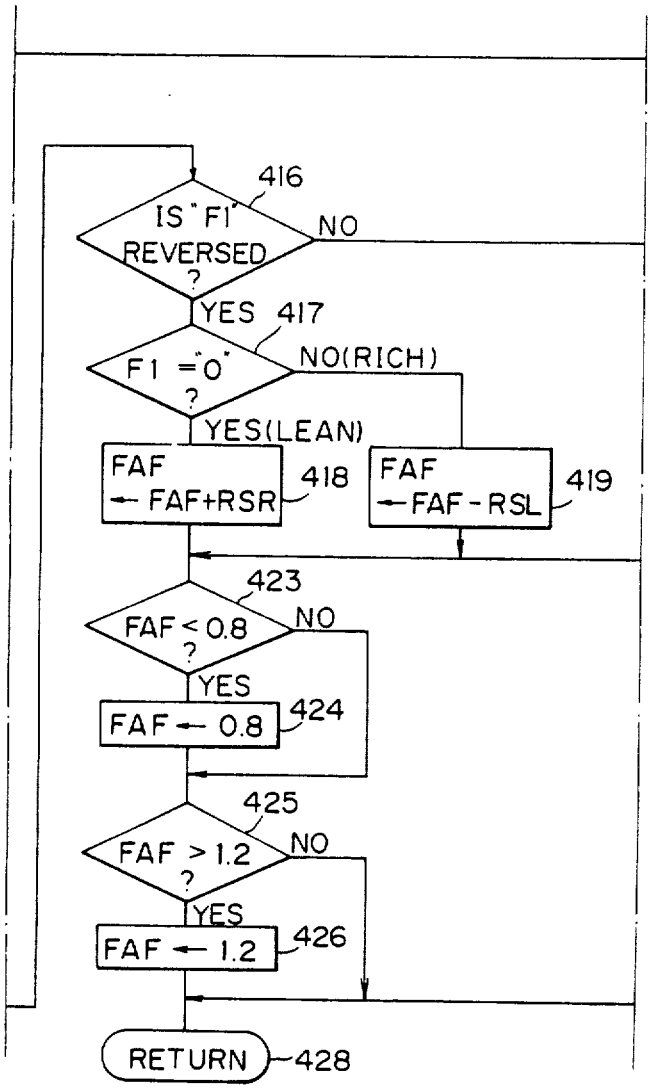
Figure 4C:
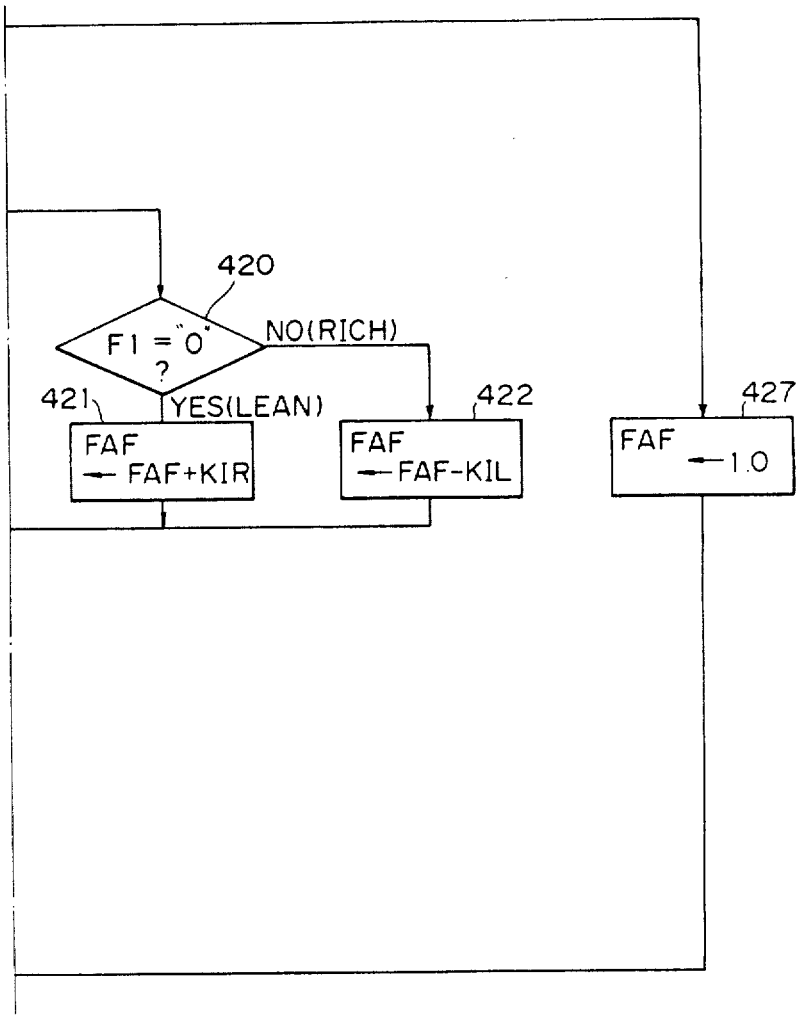

FIG. 4 is a routine for calculating a first air-fuel ratio feedback correction amount FAF in accordance with the output of the upstream-side $O_2$ sensor 13 executed at every predetermined time period such as 50 ms.

At step 401, it is determined whether or not all the feedback control (closed-loop control) conditions by the upstream-side $O_2$ sensor 13 are satisfied. The feedback control conditions are as follows:

(i) the engine is not in a starting state;

(ii) the coolant temperature THW is higher than 50° C.;

(iii) the power fuel incremental amount FPOWER is 0; and (iv) the upstream-side $O_2$ sensor 13 is not in an activated state.

Note that the determination of activation/nonactivation of the upstream-side $O_2$ sensor 13 is carried out by determining whether or not the coolant temperature THW $\geqq$ 70° C., or by whether or not the output of the upstream-side $O_2$ sensor 13 is once swung, i.e., once changed from the rich side to the lean side or vice versa. Of course, other feedback control conditions are introduced as occasion demands. However, an explanation of such other feedback control conditions is omitted.

If one or more of the feedback control conditions is not satisfied, the control proceeds to step 427, in which the amount FAF is caused to be 1.0 (FAF=1.0), thereby carrying out an open-loop control operation. Note that, in this case, the correction amount FAF can be a learning value of a value or its mean value immediately before the feedback control by the upstream $O_2$ sensor 13 is stopped. Contrary to the above, at step 401, if all of the feedback control conditions are satisfied, the control proceeds to step 402.

At step 402, an A/D conversion is performed upon the output voltage $V_1$ of the upstream-side $O_2$ sensor 13, and the A/D converted value thereof is then fetched from the A/D converter 101. Then, at step 403, the voltage $V_1$ is compared with a reference voltage $V_{R1}$ such as 0.45 V, thereby determining whether the current air-fuel ratio detected by the upstream-side $O_2$ sensor 13 is on the rich side or on the lean side with respect to the stoichiometric air-fuel ratio.

If $V_1 \leqq V_{R1}$, which means that the current air-fuel ratio is lean, the control proceeds to step 404, which determines whether or not the value of a first delay counter CDLY1 is positive. If CDLY1>0, the control proceeds to step 405, which clears the first delay counter CDLY1, and then proceeds to step 406. If CDLY1$\leqq$0, the control proceeds directly to step 406. At step 406, the first delay counter CDLY1 is counted down by 1, and at step 407, it is determined whether or not CDLY1<TDL1 Note that TDL1 is a lean delay time period for which a rich state is maintained even after the output of the upstream-side $O_2$ sensor 13 is changed from the rich side to the lean side, and is defined by a negative value. Therefore, at step 407, only when CDLY1<TDL1 does the control proceed to step 408, which causes CDLY1 to be TDL1, and then to step 409, which causes a first air-fuel ratio flag F1 to be "0" (lean state). On the other hand, if $V_1 > V_{R1}$, which means that the current air-fuel ratio is rich, the control proceeds to step 410, which determines whether or not value of the first delay counter CDLY1 is negative. If CDLY1<0, the control proceeds to step 411, which clears the first delay counter CDLY1, and then proceeds to step 412. If CDLY1$\geqq$0, the control directly proceeds to 412. At step 412, the first delay counter CDLY1 is counted up by 1, and at step 413, it is determined whether or not CDLY1>TDR1 Note that TDR1 is a rich delay time period for which a lean state is maintained even after the output of the upstream-side $O_2$ sensor 13 is changed from the lean side to the rich side, and is defined by a positive value. Therefore, at step 413, only when CDLY1>TDR1 does the control proceed to step 414, which causes CDLY1 to be TDR1, and then to step 415, which causes the first air-fuel ratio flag F1 to be "1" (rich state).

Next, at step 416, it is determined whether or not the first air-fuel ratio flag F1 is reversed, i.e., whether or not the delayed air-fuel ratio detected by the upstream-side $O_2$ sensor 13 is reversed. If the first air-fuel ratio flag F1 is reversed, the control proceeds to steps 417 to 419, which carry out a skip operation. That is, if the flag F1 is "0" (lean) at step 417, the control proceeds to step 418, which remarkably increases the correction amount FAF by a skip amount RSR. Also, if the flag F1 is "1" (rich) at step 417, the control proceeds to step 419, which remarkably decreases the correction amount FAF by the skip amount RSl. On the other hand, if the first air-fuel ratio flag F1 is not reversed at step 416, the control proceeds to steps 420 to 422, which carries out an integration operation. That is, if the flag F1 is "0" (lean) at step 420, the control proceeds to step 421, which gradually increases the correction amount FAF by a rich integration amount KIR. Also, if the flag F1 is "1" (rich) at step 420, the control proceeds to step 422, which gradually decreases the correction amount FAF by a lean integration amount KIL.

The correction amount FAF is guarded by a minimum value 0.8 at steps 423 and 424, and by a maximum value 1.2 at steps 425 and 426, thereby also preventing the controlled air-fuel ratio from becoming overrich or overlean.

The correction amount FAF is then stored in the RAM 105, thus completing this routine of FIG. 4 at step 428.

Figures 5A, 5B, 5C, 5D:
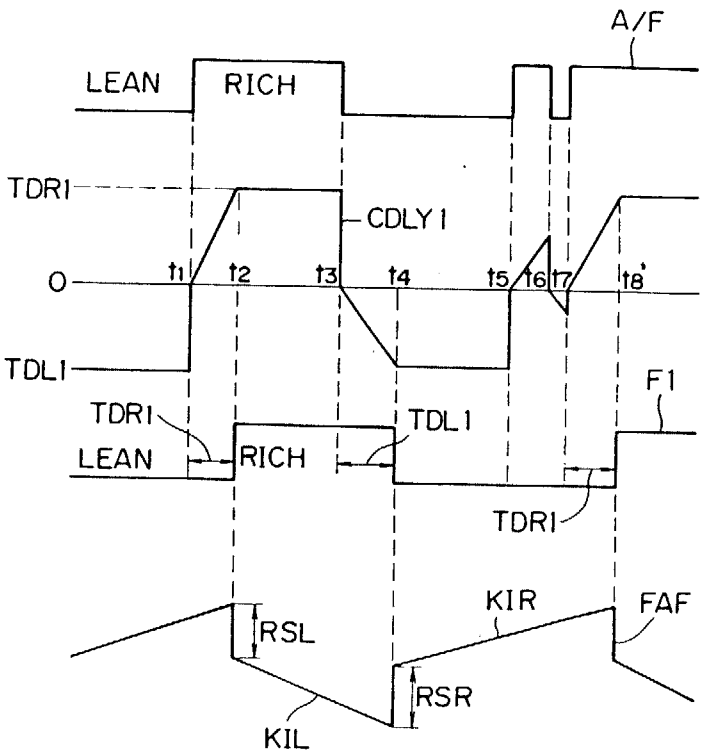
FIGS. 5A through 5D are timing diagrams explaining the flow chart of FIG. 4.

The operation by the flow chart of FIG. 4 will be further explained with reference to FIGS. 5A through 5D. As illustrated in FIG. 5A, when the air-fuel ratio A/F is obtained by the output of the upstream-side $O_2$ sensor 13, the first delay counter CDLY1 is counted up during a rich state, and is counted down during a lean state, as illustrated in FIG. 5B. As a result, a delayed air-fuel ratio corresponding to the first air-fuel ratio flag F1 is obtained as illustrated in FIG. 5C. For example, at time $t_1$, even when the air-fuel ratio A/F is changed from the lean side to the rich side, the delayed air-fuel ratio F1 is changed at time $t_2$ after the rich delay time period TDR1. Similarly, at time $t_3$, even when the air-fuel ratio A/F is changed from the rich side to the lean side, the delayed air-fuel ratio F1 is changed at time $t_4$ after the lean delay time period TDL1. However, at time $t_5$, $t_6$, or $t_7$, when the air-fuel ratio A/F is reversed within a smaller time period than the rich delay time period TDR1 or the lean delay time period TDL1, the delayed air-fuel ratio F1 is reversed at time $t_8$. That is, the delayed air-fuel ratio F1 is stable when compared with the air-fuel ratio A/F. Further, as illustrated in FIG. 5D, at every change of the delayed air-fuel ratio F1 from the rich side to the lean side, or vice versa, the correction amount FAF is shipped by the skip amount RSR or RSL, and also, the correction amount FAF is gradually increased or decreased in accordance with the delayed air-fuel ratio F1.

For example, if the rich delay time period becomes larger than the lean delay time period (TDR1>TDL1), the controlled air-fuel ratio becomes richer, and if the lean delay time period becomes larger than the rich delay time period (TDL1>TDR1), the controlled air-fuel ratio becomes leaner. Thus, the air-fuel ratio can be controlled by changing the rich delay time period TDR1 and the lean delay time period TDL1 in accordance with the output of the downstream-side $O_2$ sensor 15. In this case, however, when either the rich delay time period TDR1 or the lean delay time period TDL1 is too large, the response speed (i.e., the control frequency) is reduced, as explained before. Therefore, in the present invention, the rich delay time TDR1 and the lean delay time TDL1 are definite, for example, TDR1=12 (corresponding to 48 ms)

TDL1=−6 (corresponding to 24 ms).

The reason why the rich delay time period (−TDR1) is larger than the lean delay time period TDL1 is that there is a difference in output characteristics and deterioration speed between the upstream-side $O_2$ sensor 13 and the downstream-side $O_2$ sensor 15.

In the present invention, an additional control for the controlled air-fuel ratio by the upstream-side $O_2$ sensor 13 is carried out by changing the skip amounts RSR and RSL in accordance with the output of the downstream-side $O_2$ sensor 15. For example, if the rich skip amount RSR is increased or if the lean skip amount RSL is decreased, the controlled air-fuel ratio becomes richer, and if the lean skip amount RSL is increased or if the rich skip amount RSR is decreased, the controlled air-fuel ratio becomes leaner. Thus, the air-fuel ratio can be controlled by changing the rich skip amount RSR and the lean skip amount RSL in accordance with the output of the downstream-side $O_2$ sensor 15.

Figures 6, 6A:
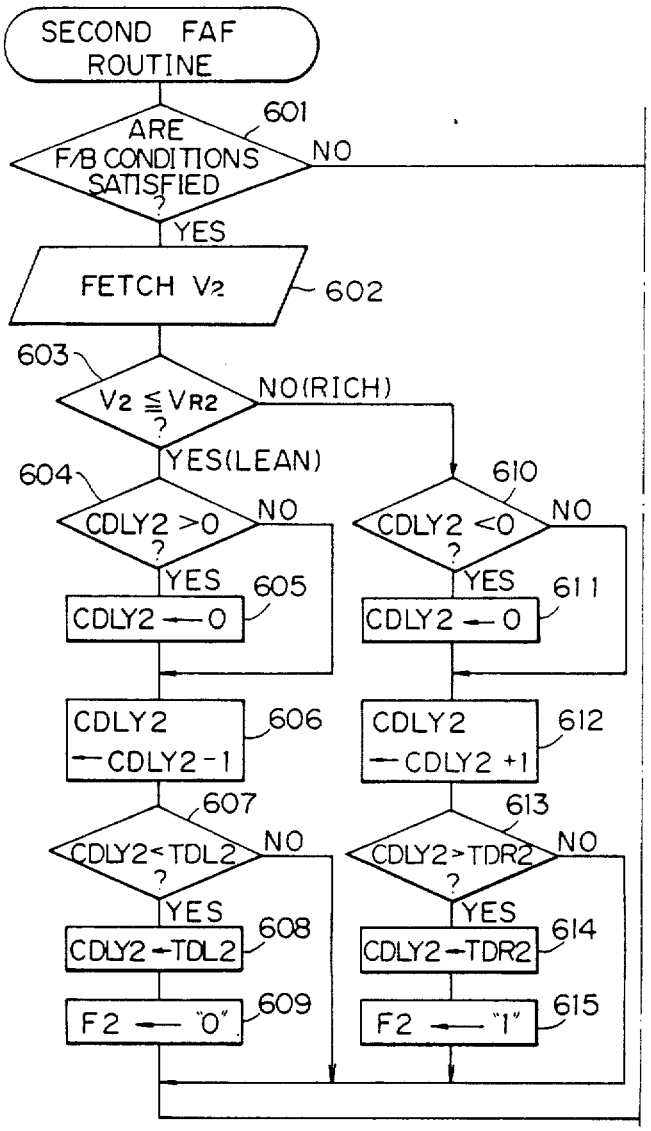
Figure 6B:
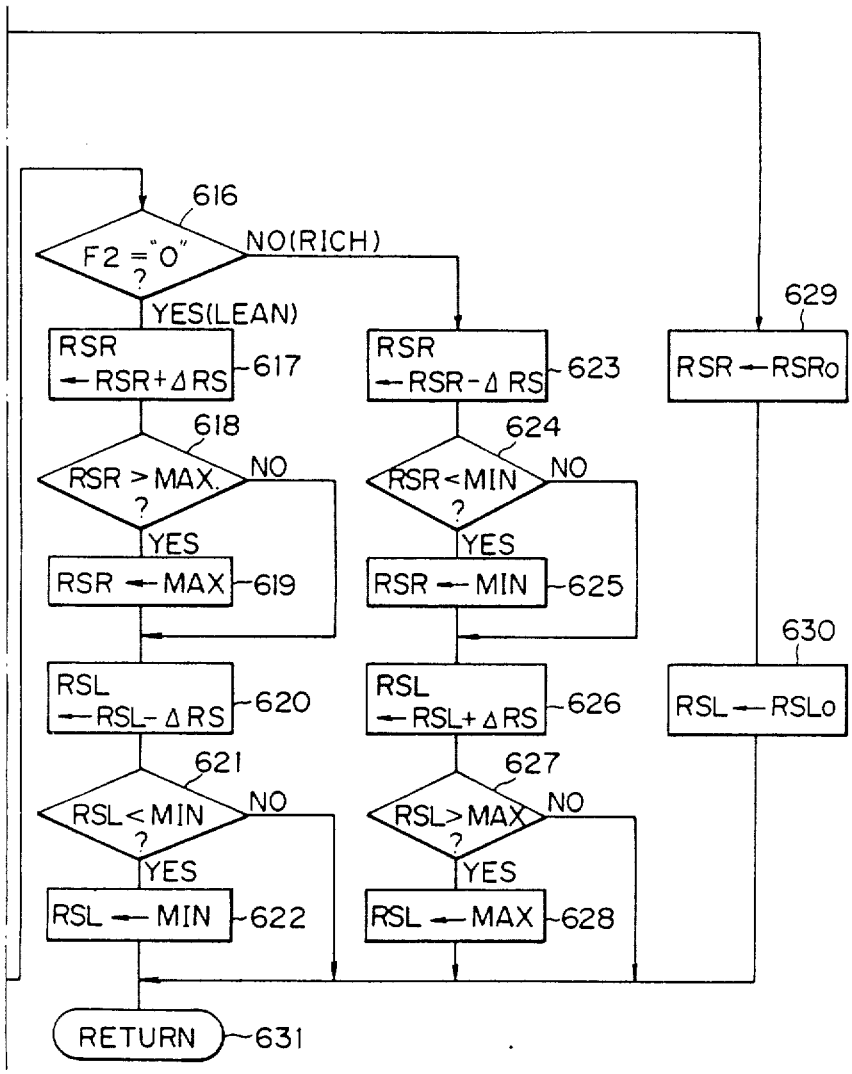

FIG. 6 is a routine for calculating the skip amounts RSR and RSL in accordance with the output of the downstream-side $O_2$ sensor 15 executed at every predetermined time period such as 1 s.

At step 601, it is determined whether or not all the feedback control (closed-loop control) conditions by the downstream-side $O_2$ sensor 15 are satisfied. The feedback control conditions are as follows:

(i) the engine is not in a starting state;

(ii) the coolant temperature THW is higher than 50° C.;

(iii) the power fuel incremental amount FPOWER is 0; and (iv) the downstream-side $O_2$ sensor 15 is not in an activated state.

Note that the determination of activation/nonactivation of the downstream-side $O_2$ sensor 15 is carried out by determining whether or not the coolant temperature THW≧70° C., or by whether or not the output of the downstream-side $O_2$ sensor 15 is once swung, i.e., is once changed from the rich side to the lean side or vice versa. Of course, other feedback control conditions are introduced as occasion demands. However, an explanation of such other feedback control conditions is omitted.

If one or more of the feedback control conditions is not satisfied, the control proceeds to step 629 in which the rich skip amount RSR is caused to be a definite value $RSR_0$ such as 5%, and also proceeds to step 630 in which the lean skip amount RSL is caused to be a definite value $RSL_0$ such as 5%, thereby carrying out an open-loop control for the downstream-side $O_2$ sensor 15. Note that, also in this case, the values RSR and RSL can be learning values of values or their mean values immediately before the feedback control by the downstream-side $O_2$ sensor 15 is stopped.

Contrary to the above, at step 601, if all of the feedback control conditions are satisfied, the control proceeds to step 602.

At step 602, an A/D conversion is performed upon the output voltage $V_2$ of the downstream-side $O_2$ sensor 15, and the A/D converted value thereof is then fetched from the A/D converter 101. Then, at step 603, the voltage $V_2$ is compared with a reference voltage $V_{R2}$ such as 0.55 V, thereby determining whether the current air-fuel ratio detected by the downstream-side $O_2$ sensor 15 is on the rich side or on the lean side with respect to the stoichiometric air-fuel ratio. Note that the reference voltage $V_{R2}$ (=0.55 V) is preferably higher than the reference voltage $V_{R1}$ (=0.45 V), in consideration of the difference in output characteristics and deterioration speed between the $O_2$ sensor 13 upstream of the catalyst converter 12 and the $O_2$ sensor 15 downstream of the catalyst converter 12.

Steps 604 through 615 correspond to steps 404 through 415, respectively, thereby performing a delay operation upon the determination at step 603. Here, a rich delay time period is defined by TDR2, and a lean delay time period is defined by TDL2. As a result of the delayed determination, if the air-fuel ratio is rich, a second air-fuel ratio flag F2 is caused to be "1", and if the air-fuel ratio is lean, the second air-fuel ratio flag F2 is caused to be "0".

At step 616, it is determined whether or not the second air-fuel ratio F2 is "0". If F2="0", which means that the air-fuel ratio is lean, the control proceeds to steps 617 through 622, and if F2="1", which means that the air-fuel ratio is rich, the control proceeds to steps 623 through 628.

At step 617, the rich skip amount RSR is increased by ΔRS to move the air-fuel ratio to the rich side. At steps 618 and 619, the rich skip amount RSR is guarded by a maximum value MAX. Further, at step 620, the lean skip amount RSL is decreased by ΔRS to move the air-fuel ratio to the rich side. At steps 621 and 622, the lean skip amount RSL is guarded by a minimum value MIN. Note that ΔRS is, for example, 0.5%/s.

On the other hand, at step 623, the rich skip amount RSR is decreased by ΔRS to move the air-fuel ratio to the lean side. At steps 624 and 625, the rich skip amount RSR is guarded by the minimum value MIN. Further, at step 626, the lean skip amount RSL is increased by ΔRS to move the air-fuel ratio to the lean side. At steps 627 and 628, the lean skip amount RSL is guarded by the maximum value MAX.

The skip amounts RSR and RSL are then stored in the RAM 105, thereby completing this routine of FIG. 6 at step 631.

Thus, according to the routine of FIG. 6, when the delayed output of the downstream-side $O_2$ sensor 15 is lean, the rich skip amount RSR is gradually increased, and the lean skip amount RSL gradually decreased, thereby moving the air-fuel ratio to the rich side. Contrary to this, when the delayed output of the downstream-side $O_2$ sensor 15 is rich, the rich skip amount RSR is gradually decreased, and the lean skip amount RSL is gradually increased, thereby moving the air-fuel ratio to the lean side.

In FIG. 6, the minimum value MIN is a level such as 3% by which the transient characteristics of the skip operation using the amounts RSR and RSL can be maintained, and the maximum value MAX is a level such as 10% by which the drivability is not deteriorated by the fluctuation of the air-fuel ratio.

In FIG. 6, it is also possible that only the rich skip amount RSR is variable while the lean skip amount RSL is fixed at $RSL_0$, and similarly, it is also possible that only the lean skip amount RSL is variable while the rich skip amount RSR is fixed at $RSR_0$.

Figures 7, 7A:
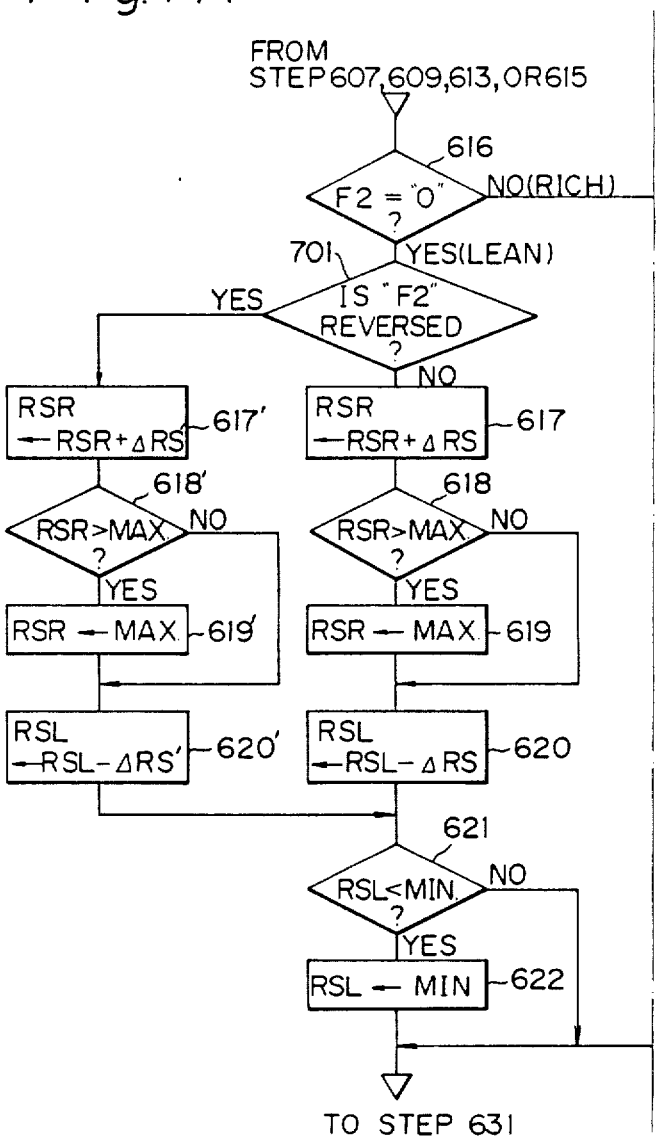
Figure 7B:
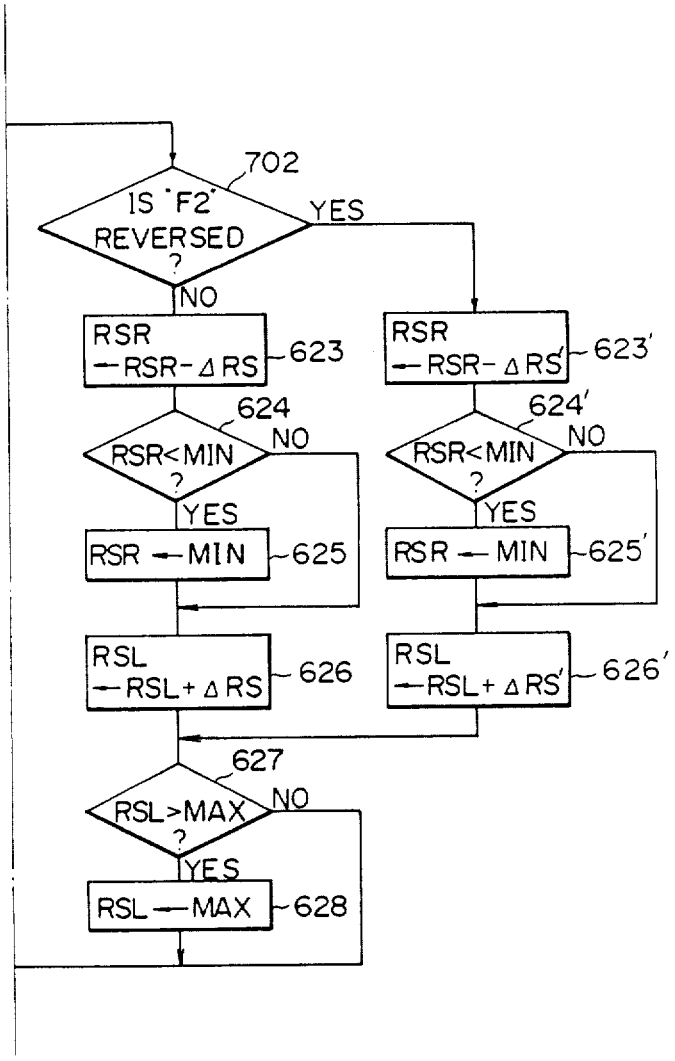

In FIG. 7, which is a partial modification of FIG. 6, steps 617' through 620', 623' through 626', 701, and 702 are added. That is, at step 616, when the second air-fuel ratio flag F2 is "0" (lean), the control proceeds to step 701, which determines whether or not the second air-fuel ratio flag F2 is reversed. Only if the second air-fuel rato flag F2 is reversed, does the control proceed to steps 617' to 620', which perform skip operations upon the skip amounts RSR and RSL. That is, at step 617', the rich integration amount RSR is remarkably increased by $\Delta RS'$ ($>RS$), and at steps 618' and 619', the rich skip amount RSR is guarded by the maximum value MAX. Further, at step 620', the lean skip amount RSL is remarkably decreased by $\Delta RS'$, and then at step 621, the lean skip amount RSL is guarded by the minimum value MIN.

Similarly, at step 616, when the second air-fuel ratio flag F2 is "1" (rich), the control proceeds to step 702, which determines whether or not the second air-fuel ratio flag F2 is reversed. Only if the second air-fuel ratio flag F2 is reversed, does the control proceed to steps 623' to 626', which perform skip operations upon the skip amounts RSR and RSL. That is, at step 623', the rich skip amount RSR is remarkably decreased by $\Delta RS'$ and at steps 624' and 625', the rich skip amount RSR is guarded by the minimum value MIN. Further, at step 626', the lean skip amount RSL is remarkably increased by $\Delta RS'$, and then at step 621, the lean skip amount RSL is guarded by the maximum value MAX.

Thus, according to the modification of FIG. 7, when the delayed air-fuel ratio detected by the downstream-side $O_2$ sensor 15 is reversed, skip operations are performed upon the skip amounts RSR and RSL, thereby further improving the transient characteristics of the skip operation using the amounts RSR and RSL.

Further, in FIG. 7, it is also possible that only the rich skip amount RSR is variable while the lean skip amount RSL is fixed at $RSL_0$, and similarly, it is also possible that only the lean skip amount RSL is variable while the rich skip amount RSR is fixed at $RSR_0$.

In FIGS. 4 and 6 (or 7), note that the calculated amounts FAF, RSR, and RSL can be stored on the backup RAM 106, thereby improving the drivability at a restarting timing of the engine.

Figure 8:
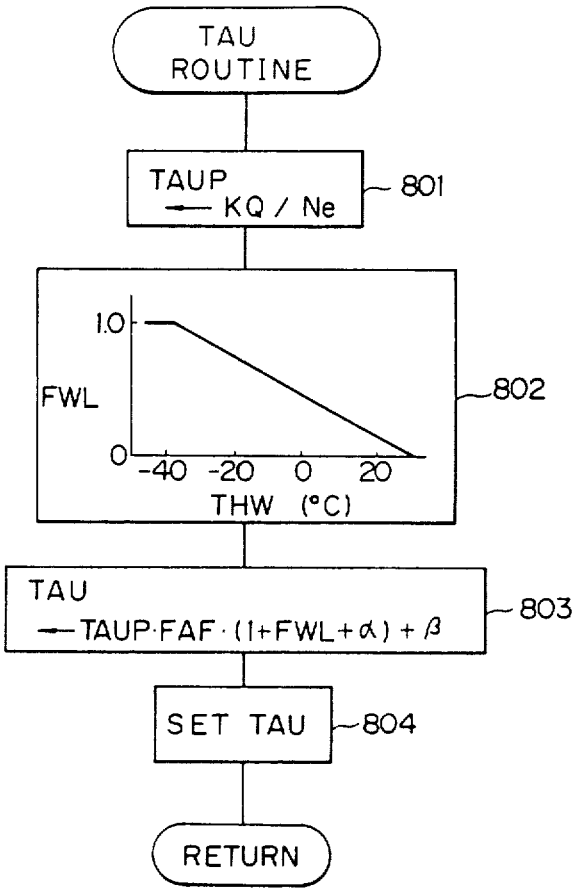

FIG. 8 is a routine for calculating a fuel injection amount TAU executed at every predetermined crank angle such as 360° CA. At step 801, a base fuel injection amount TAUP is calculated by using the intake air amount data Q and the engine speed data Ne stored in the RAM 105. That is, $$TAUP \leftarrow KQ/Ne$$

where K is a constant. Then at step 802, a warming-up incremental amount FWL is calculated from a one-dimensional map by using the coolant temperature data THW stored in the RAM 105. Note that the warming-up incremental amount FWL decreases when the coolant temperature THW increases. At step 803, a final fuel injection amount TAU is calculated by $$TAU \leftarrow TAUP \cdot FAF \cdot (1 + FWL + \alpha) + \beta$$

where $\alpha$ and $\beta$ are correction factors determined by other parameters such as the voltage of the battery and the temperature of the intake air. At step 804, the final fuel injection amount TAU is set in the down counter 108, and in addition, the flip-flop 109 is set to initiate the activation of the fuel injection valve 7. Then, this routine is completed by step 805. Note that, as explained above, when a time period corresponding to the amount TAU has passed, the flip-flop 109 is reset by the carry-out signal of the down counter 108 to stop the activation of the fuel injection valve 7.

Figures 9A, 9B, 9C, 9D:
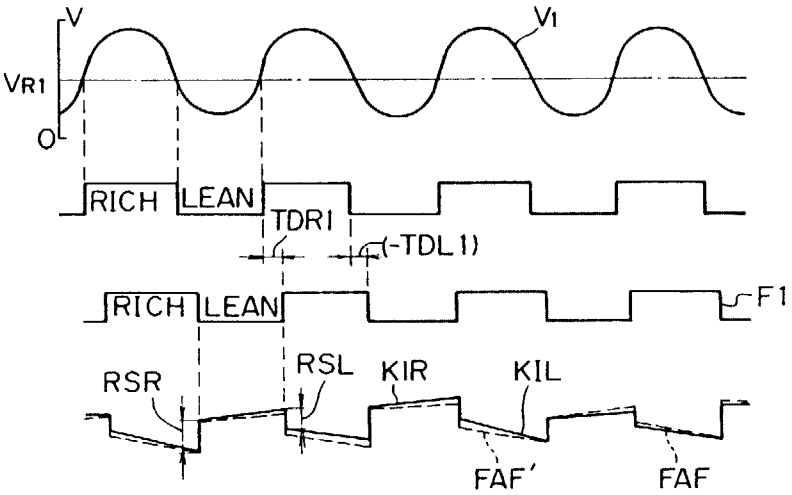
FIGS. 9A through 9I are timing diagrams explaining the flow charts of FIGS. 4, 6 (7), and 8.
Figures 9E, 9F, 9G, 9H, 9I:
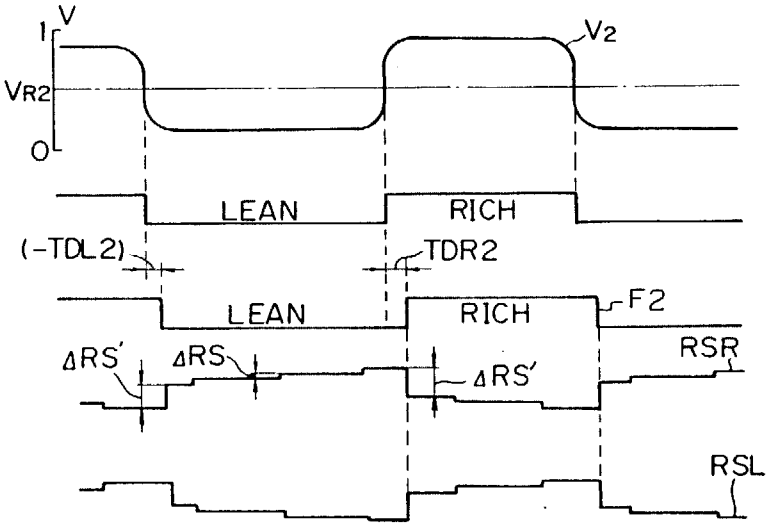

FIGS. 9A through 9I are timing diagrams for explaining the air-fuel ratio correction amount FAF and the skip amounts RSR and RSL obtained by the flow charts of FIGS. 4, 6 (7), and 8. When the output $V_1$ of the upstream-side $O_2$ sensor 13 is changed as illustrated in FIG. 9A, the determination at step 403 of FIG. 4 is shown in FIG. 9B, and a delayed determination thereof corresponding to the first air-fuel ratio flag F1 is shown in FIG. 9C. As a result, as shown in FIG. 9D, every time the delayed determination is changed from the rich side to the lean side, or vice versa, the air-fuel ratio correction amount FAF is skipped by the skip amount RSR or RSL. On the other hand, when the output $V_2$ of the second $O_2$ sensor 15 is changed as illustrated in FIG. 9E, the determination at step 603 of FIG. 6 is shown in FIG. 9F, and the delayed determination thereof corresponding to the second air-fuel ratio flag F2 is shown in FIG. 9G. As a result, as shown in FIGS. 9H and 9I, every time the delayed determination is changed from the rich side to the lean side, or vice versa, the rich skip amount RSR and the lean skip amount RSL are skipped by $\Delta RS'$, and also, the rich skip amount RSR and the lean skip amount RSL are gradually increased or decreased in accordance with the delayed output of the downstream-side $O_2$ sensor 15. Note that in FIG. 9D, the solid line indicated by FAF obtained by the routines 4, 7, and 8, is helpful in improving the transient characteristics of the controlled air-fuel ratio, as compared with the dotted line indicated by FAF' obtained by the routines 4, 6, and 8.

Figure 10:
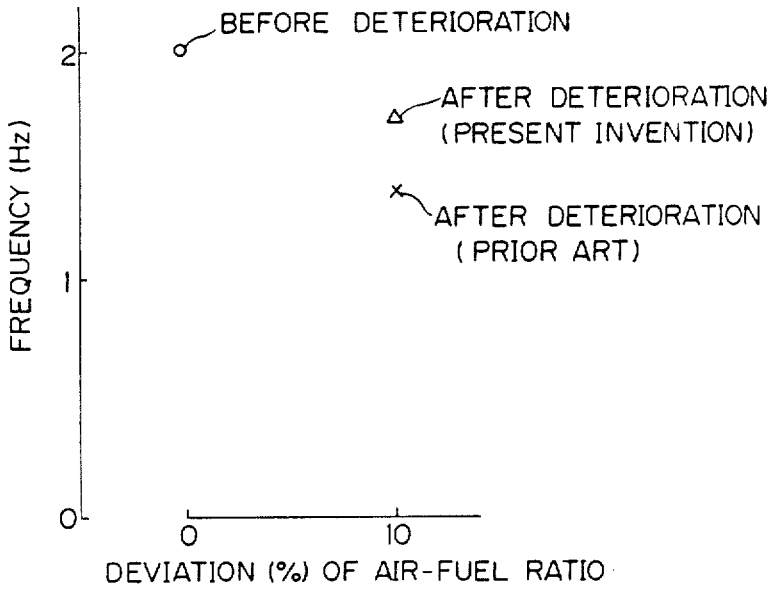
FIG. 10 is a graph showing the effect of the present invention.

Thus, the controlled center of the air-fuel ratio correction amount FAF is variable by changing the skip amounts RSR and RSL in accordance with the output fo the downstream-side $O_2$ sensor 15. For example, as shown in FIG. 10, it is assumed that, when the upstream-side $O_2$ sensor 13 is not deteriorated so that no deviation of the controlled value of the air-fuel ratio is generated, the control frequency of the air-fuel ratio (i.e., the air-fuel ratio correction amount FAF) is about 2 Hz. In this state, if the upstream-side $O_2$ sensor 13 is deteriorated so that the controlled center of the air-fuel ratio is deviated by 10%, the control frequency is made to be about 1.3 Hz by compensating for the deviation of the controlled air-fuel ratio using the correction method of the delay time parameters TDR1 and TDL1 in accordance with the output of the downstream-side $O_2$ sensor 15. Contrary to this, the control frequency is made to be about 1.8 Hz by compensating for the deviation of the controlled air-fuel ratio using the correction method of the skip amounts RSR and RSL in accordance with the output of the downstream-side $O_2$ sensor 15.

Figure 11A:
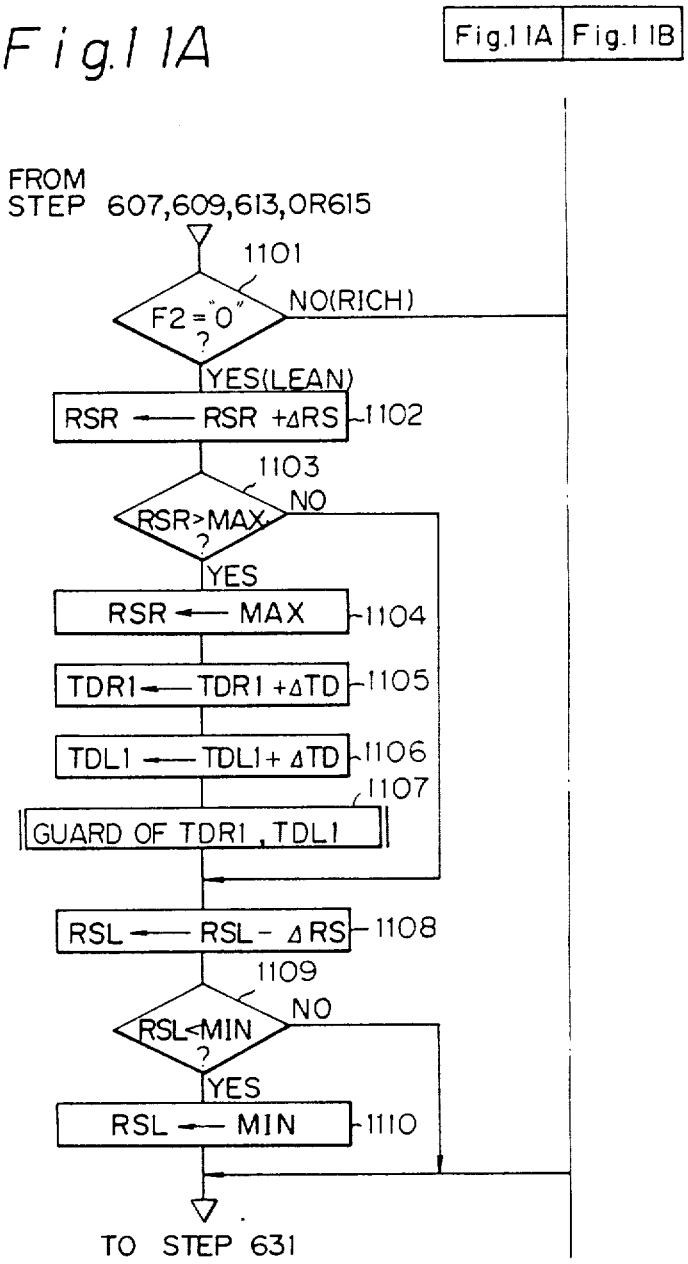
Figure 11B:
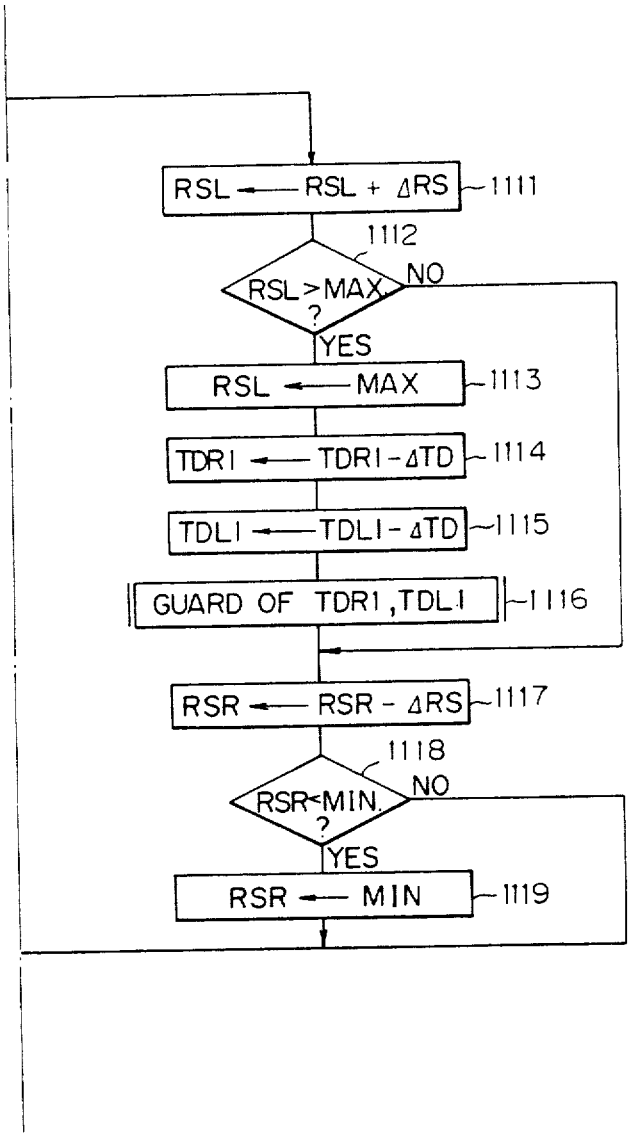

In FIG. 11, which is also a partial modification of FIG. 6, steps 1104 through 1107, and 1113 through 1116 are added, and other steps corresponds to step 616 through 628 of FIG. 6. In FIG. 11, when the skip amount RSR or RSL exceeds the maximum value MAX, the delay time period TDR1 or TDL1 is increased, thereby further adjusting the controlled air-fuel ratio. Note that the maximum value MAX of the rich skip amount RSR can be different from that of the lean skip amount RSL.

At step 1103, when RSR>MAX, the control proceeds to step 1104 which causes the rich skip amount RSR to be the maximum value MAX. Thus, when the rich skip amount RSR is guarded by the maximum value MAX, the correction of the air-fuel ratio to the rich side is limited. To compensate for the limit of the correction to the rich side, the rich delay time period TDR1 and the lean delay time period TDL1 are corrected by steps 1105 and 1106. That is, at step 1105, the rich delay time period TDR1 is increased by ΔTD which is a definite value such as 4 ms/s, and at step 1106, the lean delay time period TDL1 is also increased by ΔTD. Thus, the rich delay time period TDR1 is gradually increased, and the lean delay time period (−TDL1) is gradually decreased, thereby moving the controlled air-fuel ratio to the rich side. Then, at step 1107, the delay time periods TDR1 and TDL1 are guarded by their maximum values $T_{R1}$ and $T_{L1}$, respectively, in order to avoid reduction of the response speed. For example, the rich delay time period TDR1 is within a range from 75 (corresponding to 300 ms) to 2 (corresponding to 8 ms), and the lean delay time period TDL1 is within a range from −2 (corresponding to −8 ms) to −75 (corresponding to 300 ms).

Similarly, at step 1124 when RSL>MAX, the control proceeds to step 1113 which causes the lean skip amount RSL to be the maximum value MAX. Thus, when the lean skip amount RSL is guarded by the maximum value MAX, the correction of the air-fuel ratio to the lean side is limited. To compensate for the limit of the correction to the lean side, the rich delay time period TDR1 and the lean delay time period TDL1 are corrected by steps 1114 and 1115. That is, at step 1114, the rich delay time period TDR1 is decreased by ΔTD, and at step 1115, the lean delay time period TDL1 is also decreased by ΔTD. Thus, the rich delay time period TDR1 is gradually decreased, and the lean delay time period (−TDL1) is gradually increased, thereby moving the controlled air-fuel ratio to the lean side. Then at step 1116, the delay time periods TDR1 and TDL1 are guarded by their minimum values $T_{R2}$ and $T_{L2}$, respectively.

Note that, in an open-loop control, the delay time periods TDR1 and TDL1 are caused to be definite values $TDR_0$ such as 12 (corresponding to 48 ms) and $TDL_0$ such as −6 (corresponding to 24 ms), respectively. Also, in this case, the values can be learning values of values or their mean values immediately before the feedback control by the downstream-side $O_2$ sensor 15 is stopped.

Thus, according to FIG. 11, when the output $V_2$ of the downstream-side $O_2$ sensor 15 is lean, the rich skip amount RSR is gradually increased and the lean skip amount RSL is gradually decreased, thereby moving the air-fuel ratio to the rich side. Further, when the rich skip amount RSR reaches the maximum value MAX, the delay time periods TDR1 and TDL1 are corrected, thereby further moving the air-fuel ratio to the rich side. On the other hand, when the output $V_2$ of the downstream-side $O_2$ sensor 15 is rich, the lean skip amount RSL is gradually increased and the rich skip amount RSR is gradually decreased, thereby moving the air-fuel ratio to the lean side. Further, when the lean skip amount RSL reaches the maximum value MAX, the delay tiem periods TDR1 and TDL1 are corrected, thereby further moving the air-fuel ratio to the lean side.

Figure 12A:
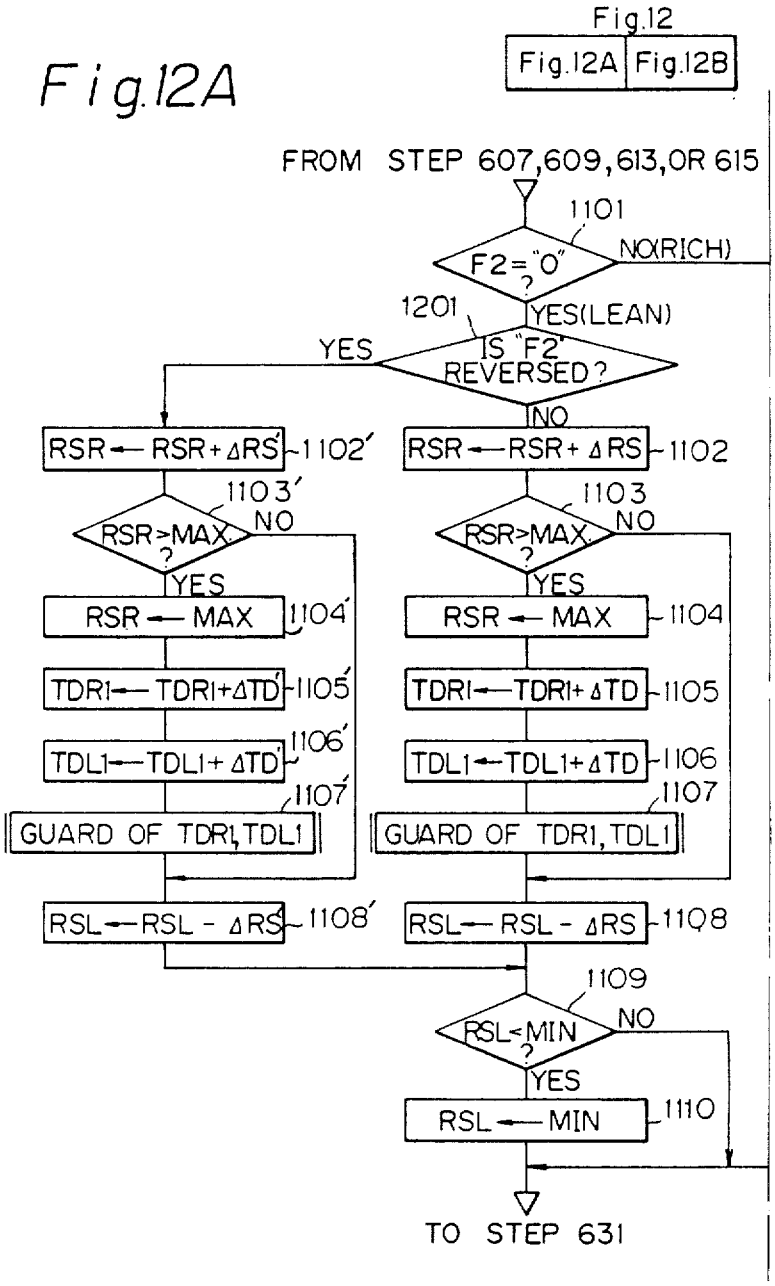
Figure 12B:
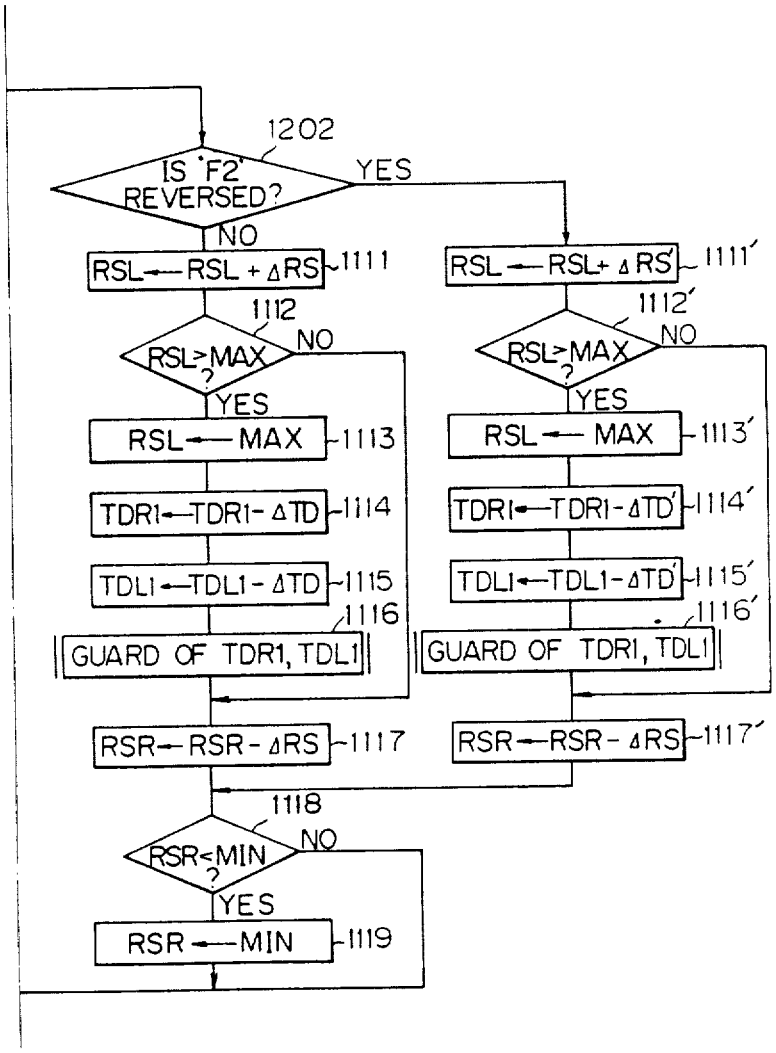

In FIG. 12, which is a modification of FIG. 11, steps 1102' through 1108', 1111' through 1117', 1201, and 1202 are added. That is, at step 1201, when the second air-fuel ratio flag F2 is "0" (lean), the control proceeds to step 1201, which determines whether or not the second air-fuel ratio flag F2 is reversed. Only if the second air-fuel ratio flag F2 is reversed, does the control proceed to steps 1102' to 1108', which perform a skip operation upon the skip amounts RSR and RSL, and the delay time periods TDR1 and TDL1. That is, at step 1102', the rich skip amount RSR is remarkably increased by ΔRS' (>RS), and at step 1103', it is determined whether or not the rich skip amount RSR is larger than the maximum value MAX. As a result, at step 1103', when RSR>MAX, the control proceeds to step 1104' which causes the rich skip amount RSR to be the maximum value MAX. Thus, when the rich skip amount RSR is guarded by the maximum value MAX, the correction of the air-fuel ratio to the rich side is limited. To compensate for the limit of the correction to the rich side, the rich delay time period TDR1 and the lean delay time period TDL1 are corrected by steps 1105' and 1106'. That is, at step 1105', the rich delay time period TDR1 is increased by ΔTD' which is also a definite value larger than ΔTD, and at step 1106', the lean delay time period TDL1 is also increased by ΔTD'. Thus, the rich delay time period TDR1 is remarkably increased, and the lean delay time period (−TDL1) is remarkably decreased, thereby moving the controlled air-fuel ratio to the rich side. Then, at step 1107', the delay time periods TDR1 and TDL1 are guarded by their maximum values $T_{R1}$ and $T_{L1}$, respectively, in order to avoid reduction of the response speed, in the same way as at step 1107. Then, at step 1108', the lean skip amount RSL is remarkably decreased by ΔRS', and the control then proceeds to steps 1109 and 1110.

Similarly, at step 1101, when the second air-fuel ratio flag F2 is "1" (rich), the control proceeds to step 1202, which determines whether or not the second air-fuel ratio flag F2 is reversed. Only if the second air-fuel ratio flag F2 is reversed, does the control proceed to steps 1111' to 1117', which perform skip operations upon the skip amounts RSR and RSL, and the delay time periods TDR1 and TDL1. That is, at step 1111', the lean skip amount RSL is remarkably increased by ΔRS' (>RS), and at step 1112', it is determined whether or not the lean skip amount RSL is larger than the maximum value MAX. As at step 1112', when RSL > MAX, the control proceeds to step 1113' which causes the lean skip amount RSL to be the maximum value MAX. Thus, when the lean skip amount RSL is guarded by the maximum value MAX, the correction of the air-fuel ratio to the lean side is limited. To compensate for the limit of the correction to the lean side, the rich delay time period TDR1 and the lean delay time period TDL1 are corrected by steps 1114' and 1115'. That is, at step 1114', the rich delay time period TDR1 is decreased by ΔTD', and at step 1115', the lean delay time period TDL1 is also decreased by ΔTD'. Thus, the rich delay time period TDR1 is remarkably decreased, and the lean delay time period (−TDL1) is remarkably increased, thereby moving the controlled air-fuel ratio to the lean side. Then at step 1116', the delay time periods TDR1 and TDL1 are guarded by their minimum values $T_{R2}$ and $T_{L2}$, respectively, in the same way as at step 1116. Then, at step 1117', the rich skip amount RSR is remarkably increased by ΔRS', and the control then proceeds to steps 1118 and 1119.

Thus, according to FIG. 12, when the output $V_2$ of the downstream-side $O_2$ sensor 15 is switched from the lean side to the rich side or vice versa, the skip amounts RSR and RSL are skipped. As a result of the skip operation of the skip amounts RSR and RSL, when one of the skip amounts RSR and RSL exceeds their maximum value MAX, the delay time periods TDR1 and TDL1 are also skipped. On the other hand, when the output $V_2$ of the downstream-side $O_2$ sensor 15 is not switched, the skip amounts RSR and RSL are gradually increased or decreased, and the delay time periods TDR1 and TDL1 are gradually increased or decreased when one of the skip amounts RSR and RSL reaches their maximum value MAX, in the same way as in FIG. 11. Therefore, the transient characteristics of the skip amounts RSR and RSL are further improved.

Figures 13A, 13B, 13C, 13D:
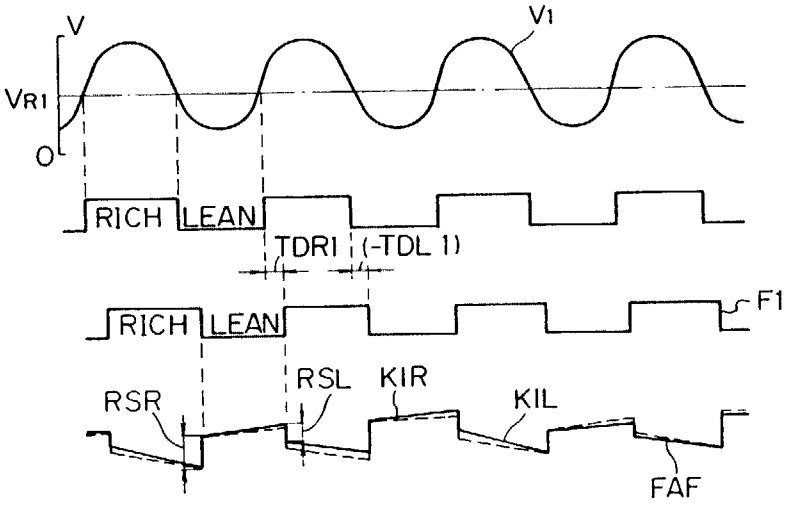
FIGS. 13A through 13K are timing diagrams explaining the flow charts of FIGS. 4, 6 (11, 12), and 8.
Figures 13E, 13F, 13G:
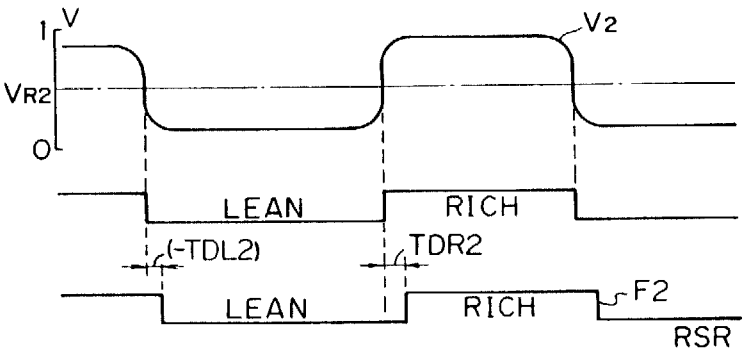
Figures 13H, 13I, 13J, 13K:
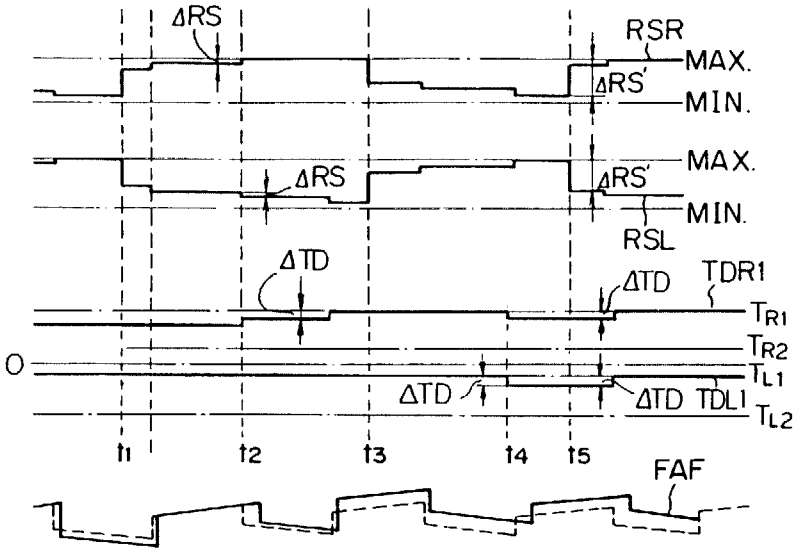

FIGS. 13A through 13K are timing diagrams for explaining the air-fuel ratio correction amount FAF and the skip amounts RSR and RSL obtained by the flow charts of FIGS. 4, 12, and 8. FIGS. 13A, 13B, 13C, 13E, 13F, and 13G are the same as FIGS. 9A, 9B, 9C, 9E, 9F, and 9G, respectively. That is, when the output $V_1$ of the upstream-side $O_2$ sensor 13 is changed as illustrated in FIG. 13A, the determination at step 403 of FIG. 4 is shown in FIG. 13B, and a delayed determination thereof corresponding to the first air-fuel ratio flag F1 is shown in FIG. 13C. As a result, as shown in FIG. 9D, every time the delayed determination is changed from the rich side to the lean side, or vice versa, the air-fuel ratio correction amount FAF is skipped by the skip amount RSR or RSL. Note that, in FIG. 13D, the skip amounts RSR and RSL are definite. On the other hand, when the output $V_2$ of the second $O_2$ sensor 15 is changed as illustrated in FIG. 13E, the determination at step 603 of FIG. 6 is shown in FIG. 13F, and the delayed determination thereof corresponding to the second air-fuel ratio flag F2 is shown in FIG. 13G. As a result, as shown in FIG. 13H, when the delayed output of the downstream-side $O_2$ sensor 15 is lean, the rich skip amount RSR is gradually increased by the time constant of ΔRS, and when the delayed output of the downstream-side $O_2$ sensor 15 is rich, the rich skip amount RSR is gradually decreased by the time constant of ΔRS. Also, at times $t_1$, $t_3$, and $t_5$ when the delayed determination of the output of the downstream-side $O_2$ sensor 15 is switched, the rich skip amount RSR is skipped by ΔRS'. Further, at time $t_2$ when the rich skip amount RSR reaches the maximum value MAX, the delay time periods TDR1 and TDL1 are gradually increased by the time constant ΔTD, as shown in FIGS. 13H and 13I. Also, as shown in FIG. 13I, when the delayed output of the downstream-side $O_2$ sensor 15 is lean, the lean skip amount RSL is gradually decreased by the time constant of ΔRS, and when the delayed output of the downstream-side $O_2$ sensor 15 is rich, the lean skip amount RSL is gradually increased by the time constant of ΔRS. Also, at times $t_1$, $t_3$, and $t_5$ when the delayed determination of the output of the downstream-side $O_2$ sensor 15 is switched, the lean skip amount RSL is skipped by ΔRS'. Further, at time $t_4$ when the lean skip amount RSL reaches the maximum value MAX, the delay time periods TDR1 and TDL1 are gradually decreased by the time constant ΔTD, as shown in FIGS. 13H and 13I.

Further, when the delayed output of the downstream-side $O_2$ sensor 15 is switched and the rich skip amount PSR or the lean skip amount RSL reaches the maximum value MAX, the delay time periods TDR1 and TDL1 are skipped by ΔTD' (not shown).

When the skip amounts RSR and RSL, and the delay time periods TDR1 and TDL1 are changed as shown in FIGS. 13H, 13I, and 13J, the air-fuel ratio correction amount FAF is changed as indicated by the solid line in FIG. 13K. Note that the dotted line in FIG. 13K shows the solid line of FIG. 13D.

Note that, if the routine of FIG. 11 is used instead of the routine of FIG. 12, no skip operation is performed upon the delay time periods TDR1 and TDL1, but the air-fuel ratio correction amount FAF is similar, as shown in FIG. 13K.

Figure 14:
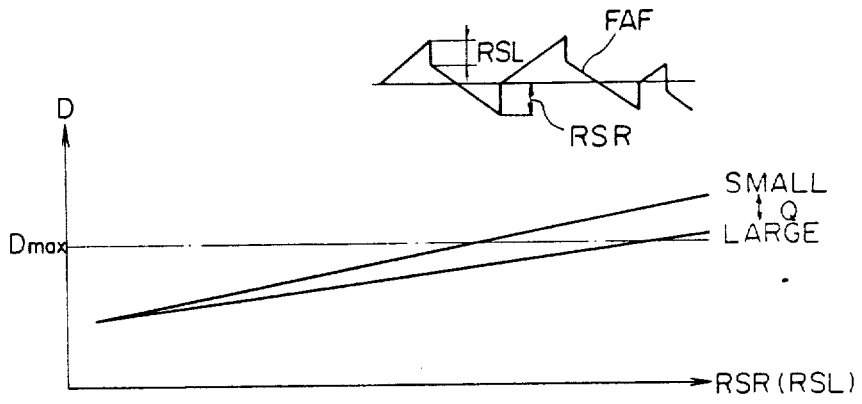
FIG. 14 is a graph showing the relationship between an air-fuel ratio feedback control parameter and the surging degree.

Generally, a skip of the air-fuel ratio correction amount FAF increases the surging degree D, since the skip of the air-fuel ratio correction amount FAF generates a fluctuation of torque. As illustrated in FIG. 14 which shows the relationship between the skip amount RSR (RSL) and the surging degree D, since, the surging degree D is sensitive to passengers when the load such as the intake air amount Q is increased, the maximum value MAX of the skip amounts RSR and RSL at an allowable surging degree $D_{max}$ should be changed in accordance with the load. If the maximum value MAX of the skip amounts RSR and RSL is at a low definite level to reduce the surging degree D during a small load sufficiently lower than the allowable surging degree $D_{max}$, the change of the air-fuel ratio is small at a large load, and accordingly, the response speed at a large load is reduced, thereby increasing the exhaust emissions such as HC, CO, and $NO_x$.

Figure 15:
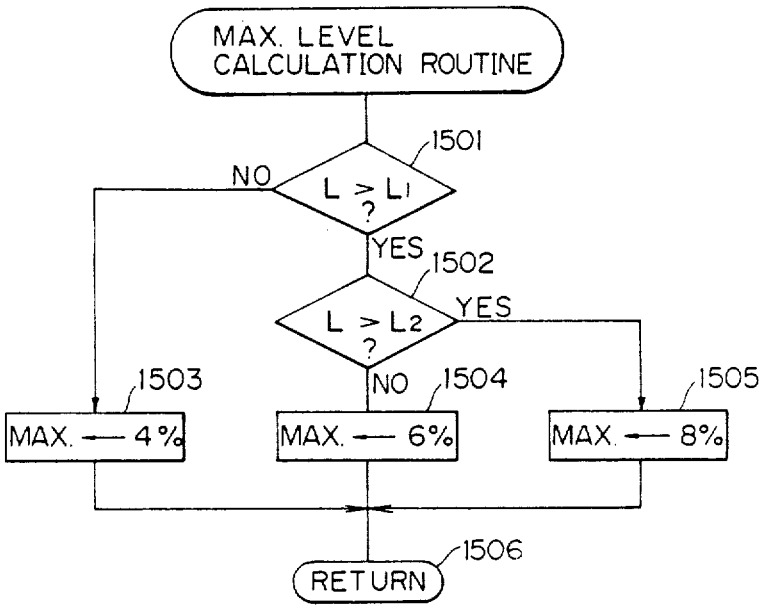

FIG. 15 is a routine for calculating the maximum level MAX of the skip amounts RSR and RSL in accordance with a load L such as the intake air amount Q, executed at every predetermined time period. At step 1501, the load L intake (for example, the air amount data Q) is read out of the RAM 105, it is determined whether or not the load L (e.g. intake air amount Q) is larger than a predetermined load $L_1$ (e.g., amount $Q_1$ which is, for example, 20 $m^3/h$). Also, at 1502, it is determined whether or not load L (e.g. intake air amount Q) is larger than a predetermined load $L_2$ (amount $Q_2$ ($<Q_1$) which is, for example, 80 $m^3/h$). As a result, when $L \leqq L_1$, the control proceeds to step 1503 which causes the maximum value to be 4%. Also when $L_1 < L \leqq L_2$, the control proceeds to step 1504 which causes the maximum value MAX to be 6%. Further, when $L > L_2$, the control proceeds to step 1505, which causes the maximum value MAX to be 8%. Thus, when the load L (such as intake air amount Q) is increased, the maximum value MAX of the skip amount RSR and RSL is also increased. Note that the maximum value MAX can be also continuously obtained by using the interpolation calculation method. Also, other load parameters such as the vehicle speed SPD, the engine speed Ne, the intake air amount per one revolution Q/Ne, the intake air pressure amount PM, the throttle opening TA, or the like, individually or in combination, can be used.

Figure 16:
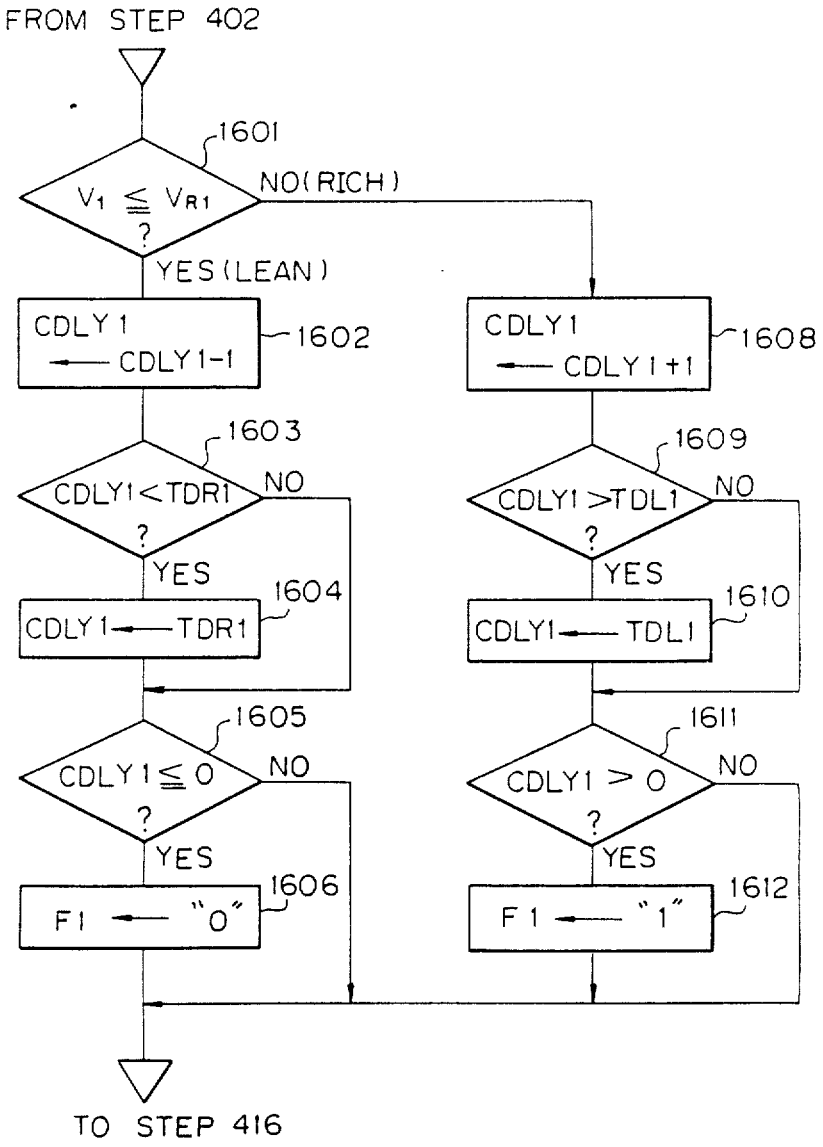

In FIG. 16, which is a modification of FIG. 4, a delay operation different from that of FIG. 4 is carried out. That is, at step 1601, if $V_1 \leqq V_{R1}$, which means that the current air-fuel ratio is lean, the control proceeds to step 1602 which decreases a first delay counter CDLY1 by 1. Then, at steps 1603 and 1604, the first delay counter DLY1 is guarded by a minimum value TDR1. Note that TDR1 is a rich delay time period for which a lean state is maintained even after the output of the upstream-side $O_2$ sensor 13 is changed from the lean side to the rich side, and is defined by a negative value.

Note that, in this case, if CDLY1 > 0, this means that the delayed air-fuel ratio is rich, while, if CDLY1 ≦ 0,- this means that the delayed air-fuel ratio is lean.

Therefore, at step 1605, it is determined whether or not CDLY ≦ 0 is satisfied. As a result, if CDLY1 ≦ 0, at step 1606, the first air-fuel ratio flag F1 is caused to be "0" (lean). Otherwise, the first air-fuel ratio flag F1 is unchanged, that is, the flag F1 remians at "1".

On the other hand, if $V_1 > V_{R1}$, which means that the current air-fuel ratio is rich, the control proceeds to step 1604 which increases the first delay counter CDLY1 by 1. Then, at steps 1609 and 1610, the first delay counter CDLY1 is guarded by a maximum value TDL1. Note that TDL1 is a lean delay time period for which a rich state is maintained even after the output of the upstream-side $O_2$ sensor 13 is changed from the rich side to the lean side, and is defined by a positive value.

Then, at step 1611, it is determined whether or not CDLY > 0 is satisfied. As a result, if CDLY°0, at step 1612, the first air-fuel ratio flag F1 is caused to be "1" (rich). Otherwise, the first air-fuel ratio flag F1 is unchanged, that is, the flag F1 remains at "0".

Figures 17A, 17B, 17C, 17D:
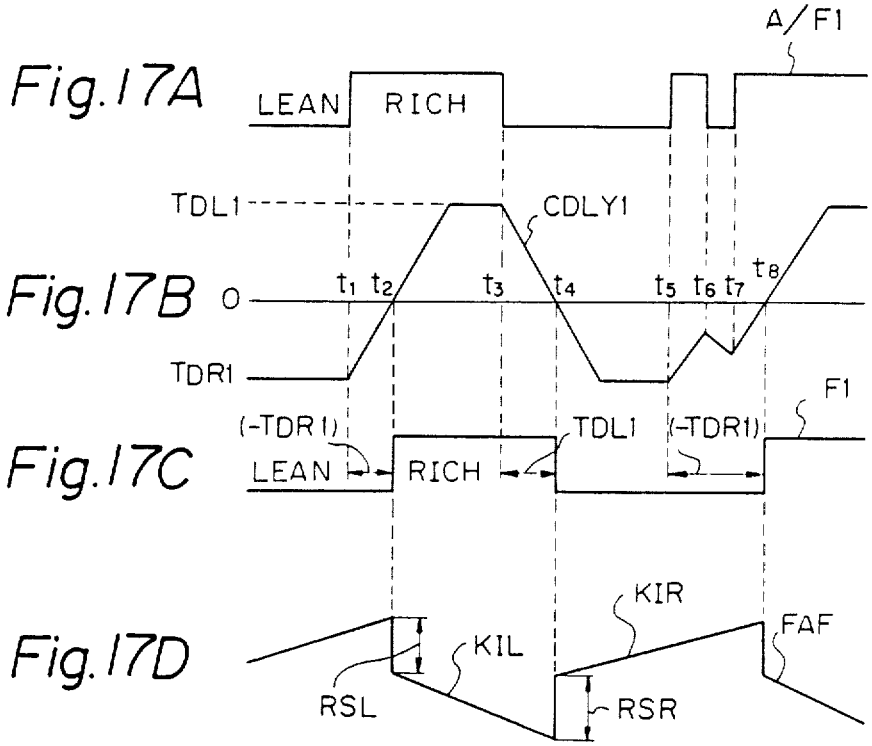
FIGS. 17A through 17D are timing diagrams for explaining the flow chart of FIG. 16.

To operation by the flow chart of FIG. 10 will be further explained with reference to FIGS. 17A through 17D. As illustrated in FIG. 17A, when the air-fuel ratio A/F1 is obtained by the output of the upstream-side $O_2$ sensor 13, the first delay counter CDLY1 is counted up during a rich state, and is counted down during a lean state, as illustrated in FIG. 17B. As a result, the delayed air-fuel ratio A/F1' is obtained as illustrated in FIG. 17C. For example, at time $t_1$, even when the air-fuel ratio A/F1 is changed from the lean side to the rich side, the delayed air-fuel ratio A/F1 is changed at time $t_2$ after the rich delay time period TDR1. Similarly, at time $t_3$, even when the air-fuel ratio A/F1 is changed from the rich side to the lean side, the delayed air-fuel ratio A/F1' is changed at time $t_4$ after the lean delay time period TDL1. However, at time $t_5$, $t_6$, or $t_7$, when the air-fuel ratio A/F is reversed within a smaller time period than the rich delay time period TDR1 or the lean delay time period TDL1, the delayed air-fuel ratio A/F1' is reversed at time $t_8$. That is, the delayed air-fuel ratio A/F1' is stable when compared with the air-fuel ratio A/F1. Further, as illustrated in FIG. 17D, at every change of the delayed air-fuel ratio A/F1' from the rich side to the lean side, or vice versa, the correction amount FAF1 is skipped by the skip amount RSR or RSL, and also, the correction amount FAF1 is gradually increased or decreased in accordance with the delayed air-fuel ratio A/F1'.

Note that, in this case, during an open-control mode, the rich delay time period TDR1 is, for example, −12 (48 ms), and the lean delay time period TDL1 is, for example, 6 (24 ms).

Figure 18:
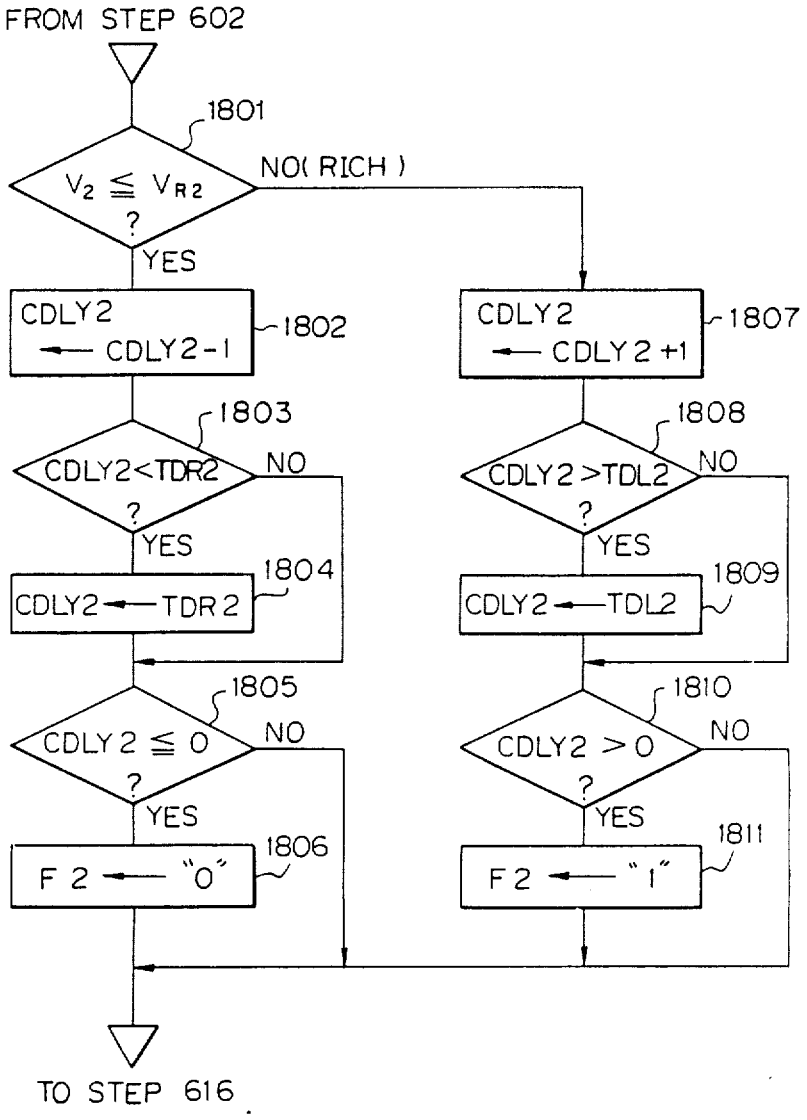

In FIG. 18, which is a modification of FIG. 6, the same delay operation as in FIG. 16 is carried out, however, its detailed explanation is omitted. Note that, in the case of FIGS. 11 (12), the delay time periods TDR1 and TDL1 are both decreased at steps 1105 and 1106 (1105' and 1106'), and the delay time periods TDR1 and TDL1 are both increased at steps 1114 and 1115 (1114' and 1115').

Also, the first air-fuel ratio feedback control by the upstream-side $O_2$ sensor 13 is carried out at every relatively small time period, such as 4 ms, and the second air-fuel ratio feedback control by the downstream-side $O_2$ sensor 15 is carried out at every relatively large time period, such as 1 s. This is because the upstream-side $O_2$ sensor 13 has good response characteristics when compared with the downstream-side $O_2$ sensor 15.

Still further, a Karman vortex sensor, a heat-wire type flow sensor, and the like can be used instead of the airflow meter.

Although in the above-mentioned embodiment, a fuel injection amount is calculated on the basis of the intake air amount and hte engine speed, it can be also calculated on the basis of the intake air pressure and the engine speed, or the throttle opening and the engine speed.

Further, the present invention can be also applied to a carburetor type internal combustion engine in which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 801 of FIG. 8 is determined by the carburetor itself, i.e., the intake air negative pressure and the engine speed, and the air amount corresponding to TAU at step 803 of FIG. 8.

Further, a CO sensor, a lean-mixture sensor or the like can be also used instead of the $O_2$ sensor.

As explained above, the functions of a double air-fuel ratio sensor system according to the present invention can be fulfilled without reducing the response speed, i.e., the control frequency.

We claim:

1. A method for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting the concentration of a specific component in the exhaust gas, comprising the steps of:

comparing the output of said upstream-side air-fuel ratio sensor with a first predetermined reference voltage;

gradually changing an air-fuel ratio correction amount in accordance with the comparison result of the output of said upstream-side air-fuel ratio sensor;

skipping up said air-fuel ratio correction amount by a rich skip amount when the comparison result of said air-fuel ratio sensor is switched from the lean side to the rich side;

skipping down said air-fuel ratio correction amount by a lean skip amount when the comparison result of said air-fuel ratio sensor is switched from the rich side to the lean side;

adjusting an actual air-fuel ratio in accordance with said air-fuel ratio correction amount;

comparing the output of said downstream-side air-fuel ratio sensor with a second predetermined reference voltage; and changing at least one of said rich and lean skip amounts in accordance with the comparison result of said downstream-side air-fuel ratio sensor.

2. A method as set forth in claim 1, wherein said skip amount changing step comprises the steps of:

gradually increasing said rich skip amount when the comparison result of the output of said downstream-side air-fuel ratio sensor is on the lean side; and gradually decreasing said rich skip amount when the comparison result of the output of said downstream-side air-fuel ratio sensor is on the rich side.

3. A method as set forth in claim 1, wherein said skip amount changing step comprises the steps of:

gradually decreasing said lean skip amount when the comparison result of the output of said downstream-side air-fuel ratio sensor is on the lean side; and gradually increasing said lean skip amount when the comparison result of the output of said downstream-side air-fuel ratio sensor is on the rich side.

4. A method as set forth in claim 2, wherein said skip amount changing step further comprises the steps of:

remarkably increasing said rich skip amount when the comparison result of the output of said downstream-side air-fuel ratio sensor is switched from the rich side to the lean side; and remarkably decreasing said rich skip amount when the comparison result of the output of said downstream-side air-fuel ratio sensor is switched from the lean side to the rich side.

5. A method as set forth in claim 3, wherein said skip amount changing step further comprises the steps of:

remarkably decreasing said lean skp amount when the comparison result of the output of said downstream-side air-fuel ratio sensor is switched from the rich side to the lean side; and remarkably increasing said lean skip amount when the comparison result of the output of said downstream-side air-fuel ratio sensor is switched from the lean side to the rich side.

6. A method as set forth in claim 1, further comprising the steps of:

guarding said rich skip amount by a first maximum level;

increasing a rich delay time period for delaying the comparsion result of said upstream-side air-fuel ratio sensor switched from the lean side to the rich side, when said rich skip amount exceeds said first maximum level;

decreasing a lean delay time period for delaying the comparison result of said upstream-side air-fuel ratio sensor switched from the rich side to the lean side, when said rich skip amount exceeds said first maximum level;

guarding said lean skip amount by a second maximum level;

decreasing said rich delay time period, when said lean skip amount exceed said second maximum level; and increasing said lean delay time period, when said lean skip amount exceeds said second maximum level.

7. A method as set forth in claim 6, further comprising the steps of:

remarkably increasing said rich delay time period, when said rich skip amount exceeds said first maximum level in such a condition that the comparison result of said downstream-side air-fuel ratio sensor is switched from the lean side to the rich side;

remarkably decreasing said lean delay time period, when said rich skip amount exceeds said first maximum level in such a condition that the comparison result of said downstream-side air-fuel ratio sensor is switched from the lean side to the rich side;

remarkably decreasing said rich delay time period, when said lean skip amount exceeds said second maximum level in such a condition that the comparison result of said downstream-side air-fuel ratio sensor is switched from the rich side to the lean side; and remarkably decreasing said lean delay time period, when said lean skip amount exceeds said second maximum level in such a condition that the comparison result of said downstream-side air-fuel ratio sensor is switched from the rich side to the lean side.

8. A method as set forth in claim 6, wherein said first and second maximum levels are variable in accordance with a predetermined driving parameter.

9. A method as set forth in claim 8, wherein said predetermined driving parameter is determined by a speed of a vehicle on which said engine is mounted, said first and second maximum levels being increased when said vehicle speed is increased.

10. A method as set forth in claim 8, wherein said predetermined driving parameter is determined by a speed of said engine, said first and second maximum levels being increased when said engine speed is increased.

11. A method as set forth in claim 8, wherein said predetermined driving parameter is determined by an intake air amount per one revolution, said first and second maximum levels being increased when said intake air amount per one revolution is increased.

12. A method as set forth in claim 8, wherein said predetermined driving parameter is determined by an intake air amount of said engine, said first and second maximum levels being increased when said intake air amount is increased.

13. A method as set forth in claim 8, wherein said predetermined driving parameter is determined by an intake air pressure of said engine, said first and second maximum levels being increased when said intake air pressure is increased.

14. A method as set forth in claim 8, wherein said predetermined driving parameter is determined by a throttling opening of said engine, said first and second maximum levels being increased when said throttling opening is increased.

15. An apparatus for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting the concentration of a specific component in the exhaust gas, comprising:

means for comparing the output of said upstream-side air-fuel ratio sensor with a first predetermined reference voltage;

means for gradually changing an air-fuel ratio correction amount in accordance with the comparison result of the output of said upstream-side air-fuel ratio sensor;

means for skipping up said air-fuel ratio correction amount by a rich skip amount when the comparison result of said air-fuel ratio sensor is switched from the lean side to the rich side;

means for skpping down said air-fuel ratio correction amount by a lean skip amount when the comparison result of said air-fuel ratio sensor is switched from the rich side to the lean side;

means for adjusting an actual air-fuel ratio in accordance with said air-fuel ratio correction amount;

means for comparing the output of said downstream-side air-fuel ratio sensor with a second predetermined reference; and means for changing at least one of said rich and lean skip amounts in accordance with the comparison result of said downstream-side air-fuel ratio sensor.

16. An apparatus as set forth in claim 15, wherein said skip amount changing means comprises:

means for gradually increasing said rich skip amount when the comparison result of the output of said downstream-side air-fuel ratio sensor is on the lean side; and means for gradually decreasing said rich skip amount when the comparison result of the output of said downstream-side air-fuel ratio sensor is on the rich side.

17. An apparatus as set forth in claim 15, wherein said skip amount changing means comprises:

means for gradually decreasing said lean skip amount when the comparison result of the output of said downstream-side air-fuel ratio sensor is on the lean side; and means for gradually increasing said lean skip amount when the comparison result of the output of said downstream-side air-fuel ratio sensor is on the rich side.

18. An apparatus as set forth in claim 16, wherein said skip amount changing means further comparises:

means for remarkably increasing said rich skip amount when the comparison result of the output of said downstream-side air-fuel ratio sensor is switched from the rich side to the lean side; and means for remarkably decreasing said rich skip amount when the comparison result of the output of said downstream-side air-fuel ratio sensor is switched from the lean side to the rich side.

19. An apparatus as set forth in claim 18, wherein said skip amount changing means further comprises:

means for remarkably decreasing said lean skip amount when the comparison result of the output of said downstream-side air-fuel ratio sensor is switched from the rich side to the lean side; and means for remarkably increasing said lean skip amount when the comparison result of the output of said downstream-side air-fuel ratio sensor is switched from the lean side to the rich side.

20. An apparatus as set forth in claim 15, further comprising:

means for guarding said rich skip amount by a first a maximum level;

means for increasing a rich delay time period for delaying the comparison result of said upstream-side air-fuel ratio sensor switched from the lean side to the rich side, when said rich skip amount exceeds said first maximum level;

means for decreasing a lean delay time period for delaying the comparison result of said upstream-side air-fuel ratio sensor switched from the rich side to the lean side, when said rich skip amount exceeds said first maximum level;

means for guarding said lean skip amount by a second maximum level;

means for decreasing said rich delay time period, when said lean skip amount exceeds said second maximum level; and means for increasing said lean delay time period, when said lean skip amount exceeds said second maximum level.

21. An apparatus as set forth in claim 20, further comprising:

means for remarkably increasing said rich delay time period, when said rich skip amount exceeds said first maximum level in such a condition that the comparison result of said downstream-side air-fuel ratio sensor is switched from the lean side to the rich side;

means for remarkably decreasing said lean delay time period, when said rich skip amount exceeds said first maximum level in such a condition that the comparison result of said downstream-side air-fuel ratio sensor is switched from the lean side to the rich side;

means for remarkably decreasing said rich delay time period, when said lean skip amount exceeds said second maximum level in such a condition that the comparison result of said downstream-side air-fuel ratio sensor is switched from the rich side to the lean side; and means for remarkably decreasing said lean delay time period, when said lean skip amount exceeds said second maximum level in such a condition that the comparison result of said downstream-side air-fuel ratio sensor is switched from the rich side to the lean side.

22. An apparatus as set forth in claim 20, wherein said first and second maximum levels are variable in accordance with a predetermined driving parameter.

23. An apparatus as set forth in claim 22, wherein said predetermined driving parameter is determined by a speed of a vehicle on which said engine is mounted, said first and second maximum levels being increased when said vehicle speed is increased.

24. An apparatus as set forth in claim 22, wherein said predetermined driving parameter is determined by a speed of said engine, said first and second maximum levels being increased when said engine speed is increased.

25. An apparatus as set forth in claim 22, wherein said predetermined driving parameter is determined by a load of said engine, said first and second maximum levels being increased when said engine load is increased.

26. An apparatus as set forth in claim 22, wherein said predetermined driving parameter is determined by an intake air amount of said engine, said first and second maximum levels being increased when said intake air amount is increased.

27. An apparatus as set forth in claim 22, wherein said predetermined driving parameter is determined by an intake air pressure of said engine, said first and second maximum levels being increased when said intake air pressure is increased.

28. An apparatus as set forth in claim 22, wherein said predetermined driving parameter is determined by a throttling opening of said engine, said first and second maximum levels being increased when said throttling opening is increased.

29. A method as set forth in claim 1, further comprising a step of guarding said rich skip amount by a maximum level.

30. A method as set forth in claim 1, further comprising a step of guarding said rich skip amount by a minimum level.

31. A method as set forth in claim 1, further comprising a step of guarding said lean skip amount by a maximum level.

32. A method as set forth in claim 1, further comprising a step of gurading said lean skip amount by a minimum level.

33. The apparatus as set forth in claim 15, further comprising means for guarding said rich skip amount by a maximum level.

34. The apparatus as set forth in claim 15, further comprising means for guarding said rich skip amount by a minimum level.

35. The apparatus as set forth in claim 15, further comprising means for guarding said lean skip amount by a maximum level.

36. The apparatus as set forth in claim 15, further comprising means for guarding said lean skip amount by a minimum level.

* * * * *

UNITED STATES PATENT AND TRADEMARK OFFICE

CERTIFICATE OF CORRECTION

PATENT NO. : 4,693,076

DATED : September 15, 1987

INVENTOR(S) : Y. CHUJO et al

It is certified that error appears in the above-identified patent and that said Letters Patent is hereby corrected as shown below:

Column 17, line 3, change "up" to --down--;

line 7, change "down" to --up--;

line 49, change "skp" to --skip--.

Column 18, line 6, change "exceed" to --exceeds--.

Column 19, line 14, change "up" to --down--;

line 18, change "down" to --up--;
line 18, change "skpping" to --skipping--.

Signed and Sealed this

Twenty-eighth Day of June, 1988

*Attest:*

DONALD J. QUIGG

*Attesting Officer*

*Commissioner of Patents and Trademarks*